US005152143A

United States Patent [19]

Kajita et al.

[11] Patent Number: 5,152,143

[45] Date of Patent: Oct. 6, 1992

[54] HYDRAULIC DRIVE SYSTEM

[75] Inventors: Yusuke Kajita, Tsuchiura; Toichi Hirata, Ushiku; Genroku Sugiyama, Ibaraki, all of Japan

[73] Assignee: Hitachi Construction Machinery Co., Ltd., Tokyo, Japan

[21] Appl. No.: 449,848

[22] PCT Filed: Aug. 31, 1989

[86] PCT No.: PCT/JP89/00893

§ 371 Date: Dec. 21, 1989

§ 102(e) Date: Dec. 21, 1989

[87] PCT Pub. No.: WO90/02268

PCT Pub. Date: Aug. 3, 1990

[30] Foreign Application Priority Data

Aug. 31, 1988 [JP] Japan ..... 63-215077

[51] Int. Cl.[5] ..... F16D 31/02

[52] U.S. Cl. ..... 60/420; 60/422; 60/426; 60/433; 60/434; 60/443; 60/444; 60/452; 60/465; 60/486; 91/517; 91/518; 91/531

[58] Field of Search ..... 91/517, 518, 531; 60/420, 422, 423, 426, 427, 433, 434, 443, 444, 452, 465, 486

[56] References Cited

U.S. PATENT DOCUMENTS

| | | | |
|---|---|---|---|
| 4,337,587 | 7/1982 | Presley . | |
| 4,617,854 | 10/1986 | Kropp . | |
| 4,697,418 | 10/1987 | Okabe et al. | 60/434 |
| 4,712,376 | 12/1987 | Hadank et al. | 60/428 X |
| 4,726,186 | 2/1988 | Tatsumi et al. | 60/434 |
| 4,739,617 | 4/1988 | Kreth et al. . | |
| 4,759,183 | 7/1988 | Kreth et al. | 60/486 X |
| 4,768,339 | 9/1988 | Aoyagi et al. | 60/427 |
| 4,809,504 | 3/1989 | Izumi et al. | 60/444 X |
| 4,856,278 | 8/1989 | Widmann et al. | 60/452 X |
| 4,864,822 | 9/1989 | Wachs et al. | 60/427 |
| 4,884,402 | 12/1989 | Strenzke et al. | 60/433 X |
| 4,942,737 | 7/1990 | Tatsumi | 60/433 X |

FOREIGN PATENT DOCUMENTS

| | | |
|---|---|---|
| 326150 | 8/1989 | European Pat. Off. . |
| 3422165 | 12/1984 | Fed. Rep. of Germany . |
| 58-135341 | 11/1983 | Japan . |
| 88/02441 | 4/1988 | World Int. Prop. O. . |

*Primary Examiner*—Edward K. Look
*Assistant Examiner*—Todd Mattingly
*Attorney, Agent, or Firm*—Fay, Sharpe, Beall, Fagan, Minnich & McKee

[57] ABSTRACT

A hydraulic drive system comprising a prime mover (21), a hydraulic pump (22) driven by the prime mover, a plurality of hydraulic actuators (23–28) driven by hydraulic fluid supplied from the hydraulic pump, a plurality of flow control valves (29–34) for controlling flow of the hydraulic fluid supplied to the actuators, and a plurality of pressure compensating valve (35–40) for controlling respective differential pressures across the respective flow control valves, in which each of the pressure compensating valves applies a control force ($f-F_c$) in a valve opening direction for setting a target value of the differential pressure across the flow control valve. There are provided a first detector (60) for detecting the target rotational speed ($N_0$) of the prime mover (21), and controllers (61, 62, 63) for controlling the control force on the basis of the target rotational speed detected by at least the first detector such that the control force ($f-F_c$) decreases in accordance with a decrease in the target rotational speed.

18 Claims, 15 Drawing Sheets

HYDRAULIC DRIVE SYSTEM

TECHNICAL FIELD

The present invention relates to hydraulic drive systems for construction machines such as a hydraulic excavator or the like and, more particularly, to a hydraulic drive system wherein hydraulic fluid of a hydraulic pump driven by a prime mover is supplied to each of a plurality of actuators in which respective differential pressures across them are controlled by a plurality of pressure compensating valves and wherein these actuators are simultaneously driven to conduct a desired combined operation.

BACKGROUND ART

In recent years, in hydraulic drive systems for a construction machine such as a hydraulic excavator, a hydraulic crane and the like, which comprise a plurality of hydraulic actuators for driving a plurality of driven units, delivery pressure of the hydraulic pump is controlled in synchronism with load pressure or requisite flow rate. Further a plurality of pressure compensating valves are arranged respectively in association with the flow control valves for controlling differential pressure across the flow control valves, whereby supply flow rates during simultaneous driving of the actuators are stably controlled. Of these hydraulic drive systems, load-sensing control is known from DE-A1-3422165 (corres. to JP-A-60-11706), U.S. Pat. No. 4,739,617 and the like, a typical example of which is the control of delivery pressure of the hydraulic pump in synchronism with load pressure. The load-sensing control is such that pump delivery rate is controlled so as to make the pump delivery pressure higher by a fixed value than the maximum load pressure among a plurality of hydraulic actuators. In these conventional examples, a swash-plate position of the hydraulic pump is controlled in response to the differential pressure between the delivery pressure of the hydraulic pump and the maximum load pressure among the plurality of actuators, to conduct the load-sensing control.

Further, in these conventional systems, when the delivery rate of the hydraulic pump reaches its maximum so that the pump delivery rate is insufficient, the hydraulic fluid is preferentially supplied to the actuator on the side of the low load pressure during the combined operation. Thus, balance of the combined operation cannot be maintained. In order to solve this problem, a control force determined on the basis of the differential pressure between the delivery pressure of the hydraulic pump and the maximum load pressure of the plurality of actuators acts directly or indirectly upon each pressure compensating valve for controlling the differential pressure across the flow control valve, in place of a spring as one for setting a target value of the differential pressure. In this arrangement, the target value of the differential pressure across the flow control valve decreases in response to a decrease in the differential pressure between the pump delivery pressure and the maximum load pressure. The pump delivery rate is accordingly distributed in response the opening ratio (requisite flow-rate ratio) of the flow control valves. Thus, it is possible to maintain the balance of the combined operation.

Additionally, the hydraulic pump is driven by the prime mover. The delivery rate of the hydraulic pump is represented by the product of a displacement volume determined by the swash-plate tilting angle of the hydraulic pump and the rotational speed of the prime mover. The pump delivery rate decreases when the target rotational speed of the prime mover decreases. Further, in the conventional systems described above, a change in the passing flow rate of each of the flow control valves, with respect to a change in a stroke of a control lever, is constant regardless of the target rotational speed of the prime mover. Accordingly, in these conventional systems, when the pump delivery rate, at the time the target rotational speed of the prime mover decreases and the displacement volume is maximum, is reduced less than the requisite flow rate at the time the opening of the flow control valve is maximum, the following result occurs. Specifically, the passing flow rate, that is the flow rate supplied to the actuators, reaches its maximum before the opening of the flow control valve reaches its maximum when the stroke of the control lever increases, so that a range capable of controlling the supply flow rate in accordance with the stroke of the control lever, that is, a metering range of the control lever stroke, is shortened. This means that the metering range varies dependent upon a change in the target rotational speed. Thus, an operator perceives a problem of operability.

Further, in the hydraulic excavator, when a precise operation such as a leveling orthopedic operation is conducted, the target rotational speed of the prime mover is frequently reduced to decrease the pump delivery rate. When the target rotational speed is reduced, however, the metering range decreases correspondingly and, further, even if the target rotational speed is reduced, a change in the passing flow rate of the flow control valve with respect to a change in the control lever stroke is constant. Accordingly, the control of the supply flow rate must be conducted at the same rate as the case of the ordinal or usual operation within the small metering range. Thus, there is a problem that the precise operation is difficult.

Moreover, assuming that there are a flow control valve that is relatively small in maximum opening, and a flow control valve that is relatively large in the maximum opening, when the target rotational speed of the prime mover is reduced, the flow rate demanded by the maximum opening of the former flow control valve is smaller than the pump delivery rate, and the flow rate demanded by the maximum opening of the latter flow control valve is larger than the pump delivery rate. Then, at the single operation which drives only the former flow control valve, it is possible to obtain the flow rate required by its maximum opening, while the pump delivery rate is insufficient at the combined operation which operates the two flow control valves simultaneously. Accordingly, the pump delivery rate is distributed in accordance with the opening ratio (requisite flow-rate ratio) of the flow control valve by the aforesaid control, and the passing flow rate of the flow control valve used in the actuator of small capacity is considerably reduced as compared with the above-mentioned single operation. In addition, when the target rotational speed of the prime mover is reduced, the pump delivery rate is made insufficient when the flow control valve that is relatively large in maximum opening is driven singly. Accordingly, the passing flow-rate ratio when the two flow control valves are singly driven respectively, and the passing flow-rate ratio in case of the combined operation are not the same as each other. From this, when the rotational speed of the prime mover is reduced to conduct the combined operation, the operator perceives an operability problem.

It is an object of the invention to provide a hydraulic drive system capable of maintaining a metering range of flow control valves substantially constant regardless of a change in target rotational speed of a prime mover.

It is another object of the invention to provide a hydraulic drive system capable of improving an operability perception when target rotational speed of a prime mover decreases.

DISCLOSURE OF THE INVENTION

For the above purposes, according to the invention, there is provided a hydraulic drive system comprising a prime mover, a hydraulic pump driven by the prime mover, a plurality of hydraulic actuators driven by hydraulic fluid supplied from the hydraulic pump, a plurality of flow control valves for controlling flow of the hydraulic fluid supplied to the actuators, and a plurality of pressure compensating valves for controlling respectively differential pressures across the respective flow control valves, the pressure compensating valves being provided respectively with drive means for applying control forces in a valve opening direction for setting target values of the differential pressures across the respective flow control valves, wherein the hydraulic drive system comprises first detecting means for detecting a target rotational speed of the prime mover, and control means for controlling the drive means on the basis of the target rotational speed detected by the first detecting means such that the control forces decrease in accordance with a decrease in the target rotational speed.

In the invention constructed in this manner, when the target rotational speed of the prime mover is reduced, the control forces applied by the drive means of the respective pressure compensating valves decrease in accordance with the decrease in the target rotational speed. Accordingly, a change ratio of the requisite flow rate with respect to the control lever stroke of the flow control valves decreases in accordance with a decrease in a maximum available delivery rate of the hydraulic pump represented by the product of the rotational speed of the prime mover and a maximum displacement volume, and thus it is possible to maintain the metering range substantially constant regardless of a change in the target rotational speed. Further, the gradient of a requisite flow-rate characteristic is reduced, so that flow rate adjustment can be effected by small gain. Thus, the precision operability is improved. Furthermore, a change in the passing flow rate of the flow control valve on the side of the small-capacity actuator at the single operation and at the combined operation is reduced, and a change in ratio of the passing flow rate of the flow control valve regarding the same actuator at translation of the single operation to the combined operation and vice versa is reduced. Thus, a perception of an operability problem is reduced, so that the operability is improved.

Further, in the invention, since the target rotational speed, not the actual rotational speed of the prime mover, is used in control of the control force of each of the pressure compensating valves, control can be conducted in accordance with the output characteristic of the prime mover which is determined by the target rotational speed. Further, a fluctuation of the control force accompanied with a frequent fluctuation of the actual rotational speed can be prevented, so that a stable control can be effected.

In one embodiment, the control means obtains a correction coefficient of the differential pressure across each of the flow control valves, which decrease in accordance with a decrease in the target rotational speed. The control means calculates a value decreasing in accordance with a decrease in the correction coefficient, as a target value of the differential pressure across the flow control valve, on the basis of the correction coefficient, and control the drive means on the basis of the value.

In a hydraulic drive system which further comprises delivery-rate control means for controlling the delivery rate of the hydraulic pump such that delivery pressure of the hydraulic pump is higher by a fixed value than the maximum load pressure of the plurality of actuators, the hydraulic drive system may further comprise second detecting means for detecting differential pressure between the delivery pressure of the hydraulic pump and the maximum load pressure of the plurality of actuators. The control means obtains a correction coefficient of each of the flow control valves, which decrease in accordance with a decrease in the target rotational speed. Further, the control means calculates a value decreasing in accordance with a decrease in the correction coefficient and with a decrease in the differential pressure detected by the second detecting means on the basis of the correction coefficient and the differential pressure, as a target value of the differential pressure across the flow control valve, and controls the drive means on the basis of the value.

Preferably, the correction coefficient is 1 when the target rotational speed is at maximum rotational speed, and decreases at the same rate as the decreasing rate of the target rotational speed.

Further, the correction coefficient may be 1 when the target rotational speed is at maximum rotational speed, and the correction coefficient may be a value larger than the ratio of a relatively high first rotational speed, which is less than the maximum rotational speed, when the target rotational speed is at the first rotational speed, alternatively, the correction coefficient may be a value less than the ratio of a relatively small second rotational speed, which is less than the maximum rotational speed, when the target rotational speed is at the second rotational speed.

Preferably, the control means includes a controller for calculating a value of control force to be applied by the drive means on the basis of at least the target rotational speed and for outputting a control signal corresponding to the value, and control-pressure generating a means for generating control pressure in accordance with the control signal and for outputting the control pressure to the drive means. The control-pressure generating means may include a single solenoid proportion pressure reducing valve operative in response to the control signal. The control-pressure generating means may include a pilot hydraulic-fluid source, a variable relief valve interposed between the pilot hydraulic-fluid source and a tank and operative in response to the control signal, a restrictor valve interposed between the variable relief valve and the pilot hydraulic-fluid source, and a line between the variable relief valve and the throttle valve communicating with the drive means of the respective pressure compensating valve.

Moreover, the control means may include a controller for calculating values of control force to be applied by the drive means on the basis of at least the target rotational speed individually for each of the pressure compensating valves, and for outputting control signals in accordance with the values, and control-pressure generating means for generating control pressures in accordance with the respective control signals and for outputting these control pressures respectively to the drive means. In this case, the control-pressure generating means can include a plurality of solenoid proportional pressure reducing valves provided for the respective pressure control valves, and operative respectively in response to the control signals.

Each of the drive means of the pressure compensating valves can include a spring for urging in the valve opening direction, and a drive section for applying control force in a valve closing direction, wherein the control force of the drive means in the valve opening direction is obtained as a resultant force of the force of the spring and the control force of the drive section in the valve closing direction, and wherein the control means controls the control force of the drive section in the valve closing direction to control the control force of the drive means in the valve opening direction.

Furthermore, each of the drive means of the pressure compensating valves may include a drive section for applying a control force in the valve opening direction, wherein the control means directly controls the control force in the valve opening direction.

Further, each of the drive means of the pressure compensating valves may include a spring for urging in the valve opening direction, and a drive section for applying a control force in the valve opening direction, which varies a pre-set force of the spring, the control force of the drive means in the valve opening direction being obtained as the pre-set force of the spring, wherein the control means controls the control force of the drive section in the valve opening direction to control the control force of the drive means in the valve opening direction.

Moreover, each of the drive means of the pressure compensating valves may include a first drive section for applying a constant control force in the valve opening direction by action of constant pressure, and a second drive section for applying a control force in a valve closing direction, wherein the control force of the drive means in the valve opening direction is obtained as a resultant force of the constant force of the first drive section in the valve opening direction and the control force of the second drive section in the valve closing direction, and wherein the control means controls the control force of the second drive section in the valve closing direction to control the control force of the drive means in the valve opening direction.

BEST MODE FOR CARRYING OUT THE INVENTION

Preferred embodiments of the invention will be described below with reference to the drawings.

FIRST EMBODIMENT

A first embodiment of the invention will first be described with reference to FIGS. 1~14.

Figure 1:
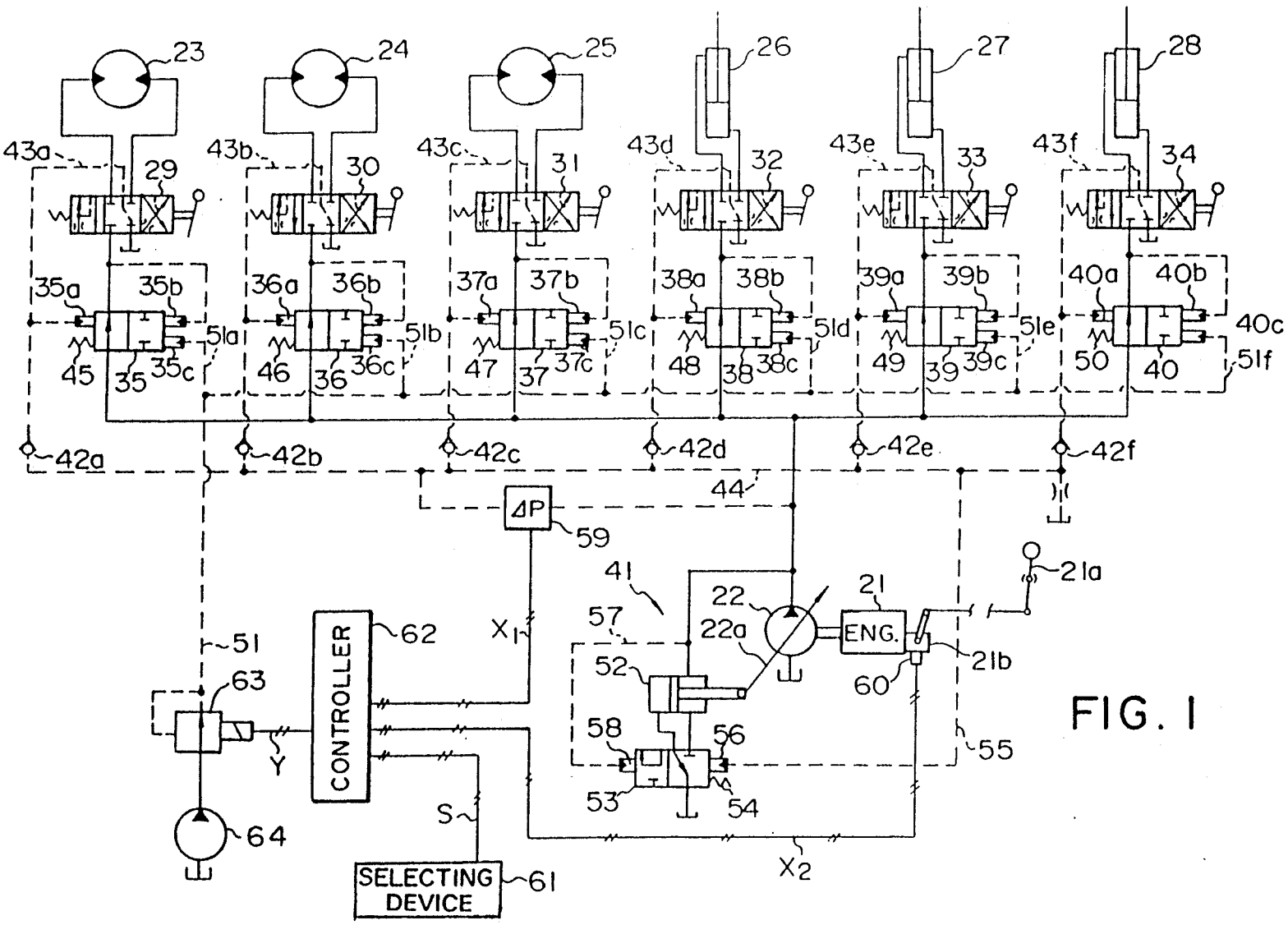
FIG. 1 is a schematic view showing an entire construction of a hydraulic drive system according to an embodiment of the invention.

In FIG. 1, a hydraulic drive system according to the embodiment is applied to a hydraulic excavator, and comprises a prime mover, or engine, 21 in which target rotational speed is set by a fuel lever 21*a*, a single hydraulic pump of variable displacement type, or a single main pump, 22, driven by the engine 21, a plurality of actuators, or swing motor, 23, a left-hand travel motor 24, a right-hand travel motor 25, a boom cyclinder 26, an arm cylinder 27 and a bucket cylinder 28, which are driven by hydraulic fluid discharged from the main pump 22, a plurality of flow control valves, or swing directional control valve, 29, a left-hand travel directional control valve 30, a right-hand travel directional control valve 31, a boom directional control valve 32, an arm directional control valve 33 and a bucket directional control valve 34, which control flows of the hydraulic fluid supplied respectively to the plurality of actuators, and a plurality of pressure compensating valves 35, 36, 37, 38, 39 and 40 which control respectively differential pressures $\Delta P_{v1}$, $\Delta P_{v2}$, $\Delta P_{v3}$, $\Delta P_{v4}$ $\Delta P_{v5}$ and $\Delta P_{v6}$ these flow control valves.

The main pump 22 has a delivery rate which is controlled by a delivery control unit 41 of load-sensing control type such that delivery pressure $P_s$ of the main pump 22 is brought to a value higher than maximum load pressure $P_{amax}$ of the actuators 23~28 by a predetermined valve.

Connected respectively to the flow control valves 29~34 are load lines 43*a*, 43*b*, 43*c*, 43*d*, 43*e* and 43*f* which are provided with respective check valves 42*a*, 42*b*, 42*c*, 42*d*, 42*e* and 42*f* for detecting load pressures of the respective actuators 23~28 during driving of the actuators. These load lines 43*a*~43*f* are connected further to a common maximum load line 44.

Each of the pressure compensating valves 35~40 is constructed as follows. The pressure compensating valve 35 comprises a drive section 35*a* to which outlet pressure of the swing directional control valve 29 is introduced to urge the pressure compensating valve 35 in a valve opening direction, and a drive section 35*b* to which inlet pressure of the swing directional control valve 29 is introduced to urge the pressure compensating valve 35 in a valve closing direction, to thereby apply force in the valve closing direction on the basis of the differential pressure $\Delta P_{v1}$ across the swing directional control valve 29. Further, the pressure compensating valve 35 also comprises a spring 45 for urging the pressure compensating valve 35 under force f in the valve opening direction, and a drive section 35*c* to which control pressure $P_c$ to be described subsequently is introduced through a pilot line 51*a* to generate control force $F_c$ urging the pressure compensating valve 35 in the valve closing direction, to thereby apply control force f-$F_c$ in the valve opening direction opposite to the force in the valve closing direction on the basis of the differential pressure $\Delta P_{v1}$ by resultant force of the force f of the spring 45 and the control force $F_c$ of the drive section 35*c*. Here, the control force f-$F_c$ in the valve opening direction sets a target valve of the differential pressure $\Delta P_{v1}$ across the swing directional control valve 29.

Other pressure compensating valves 36~40 are constructed similarly to the above. The pressure compensating valves 36~40 comprise respective drive sections 36*a*, 36*b*; 37*a*, 37*b*; 38*a*, 38*b*; 39*a*, 39*b*; and 40*a*, and 40*a*, 40*b* which apply forces in the valve closing direction on the basis of the differential pressures $\Delta P_{v2}$~$\Delta P_{v6}$ across the respective flow control valves 30~34, and springs 46, 47, 58, 59 and 50 and drive sections 36*c*, 37*c*, 38*c*, 39*c* and 40*c* which apply the control force f-$F_c$ in the valve opening direction opposite to the force in the valve closing direction on the basis of the differential pressures $\Delta P_{v2}$~$\Delta P_{v6}$. The control pressure $P_c$ is introduced to these drive sections through respective pilot lines 51*b*, 51*c*, 51*d*, 51*e* and 51*f*.

The delivery control unit 41 comprises a drive cylinder device 52 for driving a swash plate 22*a* of the main pump 22 to control a displacement volume thereof. and a control valve 53 for controlling displacement of the drive cylinder device 52. The control valve 53 is provided with a spring 54 for setting target differential pressure $\Delta P_{LSO}$ between the delivery pressure $P_s$ of the main pump 22 and the maximum load pressure $P_{amax}$ of the actuators 23~28, a drive section 56 to which the maximum load pressure $P_{amax}$ of the actuators 23~28 is introduced through a line 55, and a drive section 58 to which the delivery pressure $P_s$ of the main pump 22 is introduced through a line 57. When the maximum load pressure $P_{amax}$ increases, the attendant driving of the control valve 53 to the left in the figure causes the drive cylinder device 52 to be driven to the left in the figure, to increase the displacement volume of the main pump 22, thereby controlling the pump delivery rate so as to hold the target differential pressure $\Delta P_{LSO}$.

The hydraulic drive unit further comprises a differential-pressure detector 59 to which the delivery pressure $P_s$ of the main pump 22 and the maximum load pressure $P_{amax}$ of the actuators 23~28 are introduced to detect differential pressure $\Delta P_{LS}$ between them and to output a corresponding signal $X_1$, a rotational-speed detector 60 for detecting a target rotational speed $N_0$ of the engine 21 set by the fuel lever 21*a*, and for outputting a corresponding signal $X_2$, a selecting device 61 for selecting whether or not metering control of the flow control valves 29~34 subsequently to be described is carried out, and for outputting a signal S when carrying-out of the metering control is selected, a controller 62 into which the signals $X_1$, $X_2$ and S are inputted to calculate the control force to be applied by the drive sections 35*c*~40*c* of the respective pressure compensating valves 35~40 on the basis of the detected differential pressure $\Delta P_{LS}$ and target rotational speed $N_0$ as well as the signal S, and to output a corresponding command signal Y, and control-pressure generating means, for example, a solenoid proportional pressure reducing valve 63, into which the command signal Y is inputted to generate a corresponding control pressure $P_c$ on the basis of the delivery pressure from a pilot pump 64. The control pressure $P_c$ from the solenoid valve 63 is transmitted to the pilot lines 51*a*~51*f* through the pilot line 51 and then to the drive sections 35*c*~40*c*.

In the embodiment, the rotational-speed detector 60 is provided on a fuel injection device 21*b* of the engine 21 to detect displacement of a rack, for example, which determines a fuel injection amount of the fuel injection device 21*b*.

Figure 2:
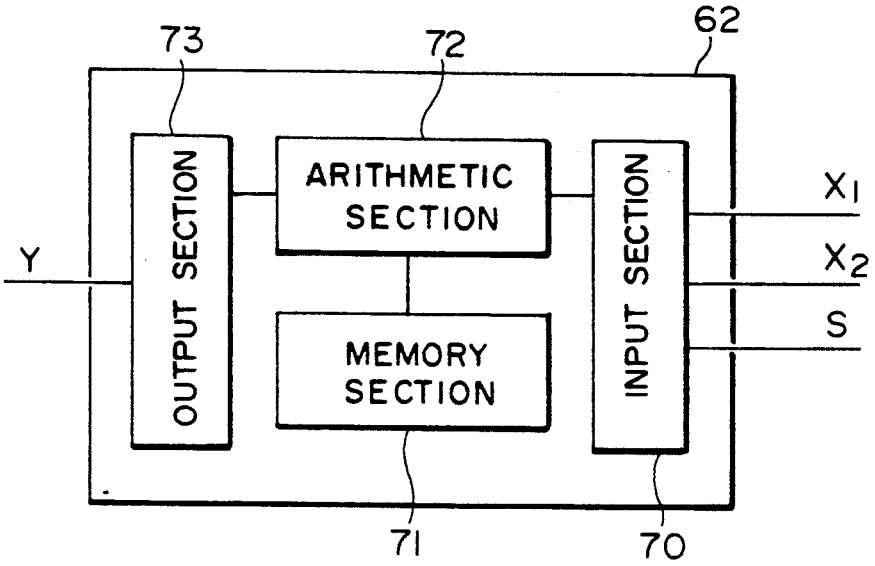
FIG. 2 is a schematic view showing a hard block diagram of a controller.

As shown in FIG. 2, the controller 62 comprises an input section 70 having inputted thereto the signals $X_1$, $X_2$ and S, a memory section 71 having stored therein a control program and functional relationships, an arithmetic section 72 for calculating the control force in accordance with the control program and the functional relationships, and an output section 73 for outputting a value of the control force $F_c$ obtained by the arithmetic section 72, as the control signal Y.

The functional relationships shown in FIGS. 3 through 6, for example, are stored in the memory section 71 of the controller 62.

Figure 3:
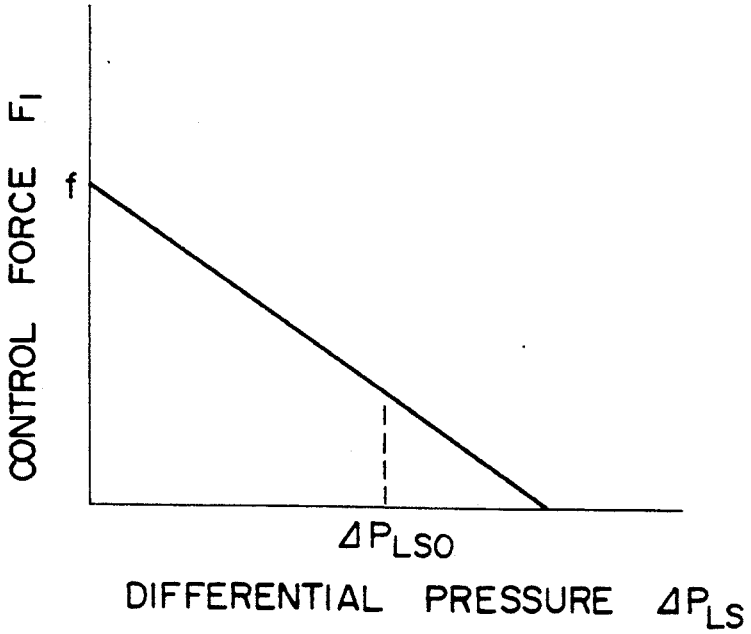
FIG. 3 is a view showing a first functional relationship between differential pressure $\Delta P_{LS}$ between pump delivery pressure and maximum load pressure, and a first control force $F_1$.

FIG. 3 shows a first functional relationship which defines the relationship between the differential pressure $\Delta P_{LS}$ between the pump delivery pressure $P_s$ and the maximum load pressure $P_{amax}$, and the first control force $F_1$ to be applied by the drive sections 35c~40c of the respective pressure compensating valves 35~40. The functional relationship is such that when $\Delta P_{LS}=0$ (zero), $F_1=f$, and the control force $F_1$ decreases in accordance with an increase in the differential pressure $\Delta P_{LS}$. Here, f represents the forces of the aforementioned respective springs 45~50, and $\Delta P_{LSO}$ is the target differential pressure of load sensing control described above.

Figure 4:
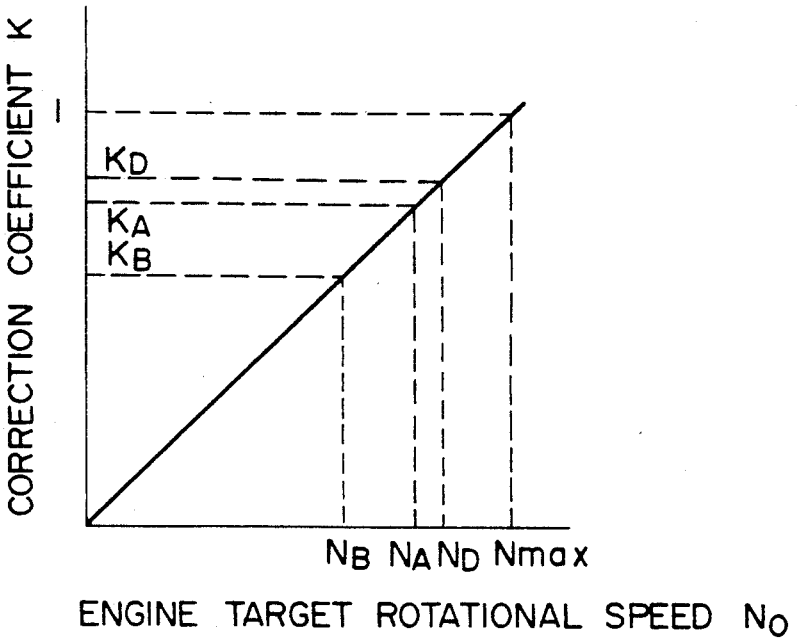
FIG. 4 is a view showing a second functional relationship between target rotational speed $N_0$ of an engine and correction coefficient K.

FIG. 4 shows a second functional relationship which defines the relationship between the target rotational speed $N_0$ of the engine 21 and correction coefficient K of the differential pressures $\Delta P_{v1} \sim \Delta P_{v6}$ across the flow control valves 29~34. The functional relationship is such that when the target rotational speed $N_0=N_{max}$, $K=1$, and the correction coefficient K decreases in accordance with a decrease in the target rotational speed $N_0$ in a linear proportional relationship, that is, at the same rate as a decrease in the target rotational speed $N_0$.

Figure 5:
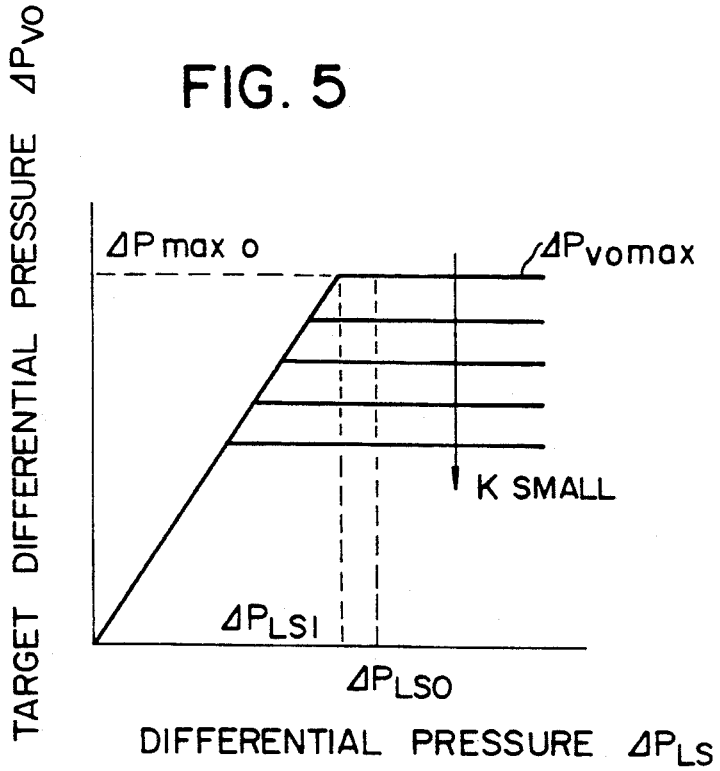
FIG. 5 is a view showing a third functional relationship among the correction coefficient K, the differential pressure $\Delta P_{LS}$ and target differential pressure $\Delta P_{v0}$.

FIG. 5 shows a third functional relationship which defines the relationship among the differential pressure $\Delta P_{LS}$, the correction coefficient K and the target values of the respective differential pressures $\Delta P_{v1} \sim \Delta P_{v6}$ across the flow control valves 29~34, that is, the target differential pressure $\Delta P_{v0}$ of the pressure compensating control. The functional relationship is such that when $K=1$, the differential pressure $\Delta P_{LS}$ indicates $\Delta P_{max}$ as a constant maximum value $\Delta P_{v0max}$ within a range of $\Delta P_{LS} \geqq \Delta P_{LS1}$ including the target differential pressure $\Delta P_{LS0}$, and the target differential pressure $\Delta P_{v0}$ decreases in accordance with decrease in $\Delta P_{LS}$ within a range of $\Delta P_{LS1} < \Delta P_{LS1}$ while the constant $\Delta P_{v0max}$ decreases to a value less than $\Delta P_{max0}$ in accordance with a decrease in the correction coefficient K from 1 (one). Here, the constant maximum value of the target differential pressure $\Delta P_{v0}$, that is, the constant maximum target differential pressure $\Delta P_{v0max}$ at the time $K<1$ satisfies the relation $\Delta P_{v0max}=K^2.\Delta P_{max0}$.

Figure 6:
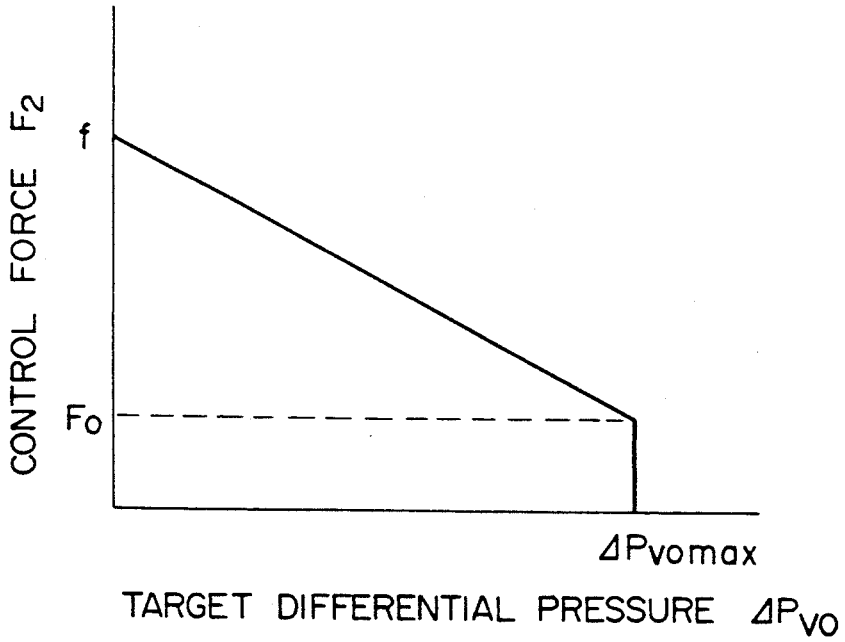
FIG. 6 is a view showing a fourth functional relationship between the target differential pressure $\Delta P_{v0}$ and second control force $F_2$.

FIG. 6 shows a fourth functional relationship which defines the relationship between the target differential pressure $\Delta P_{v0}$ of pressure compensation and the second control force $F_2$ to be applied by the drive sections 35c~40c of the pressure compensating valves 35~40. The functional relationship is such that when $\Delta P_{v0}=0$, $F_2=f$, the control force $F_2$ decreases in accordance with an increase in the target differential pressure $\Delta P_{v0}$, and when $\Delta P_{v0}=\Delta P_{v0max}$, $F_2=F_0$.

Figure 7:
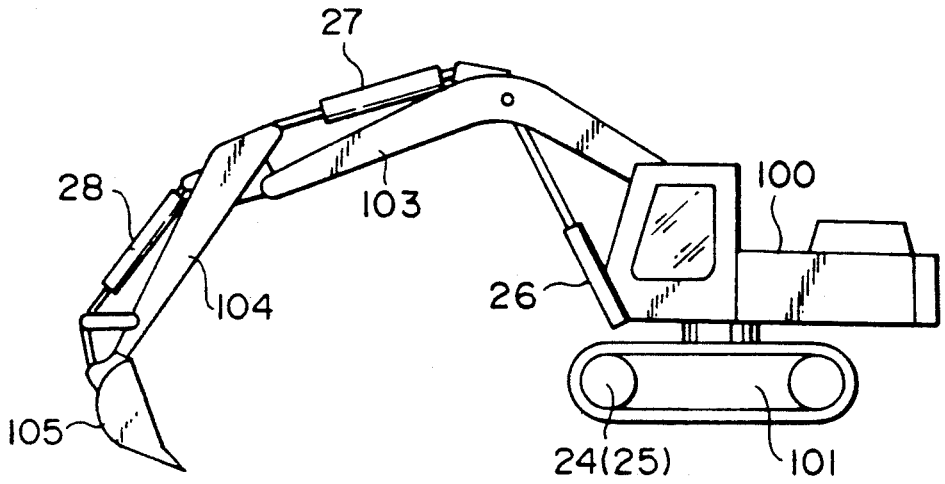
FIG. 7 is a side elevational view of a hydraulic excavator in which the hydraulic drive system according to the embodiment is used.
Figure 8:
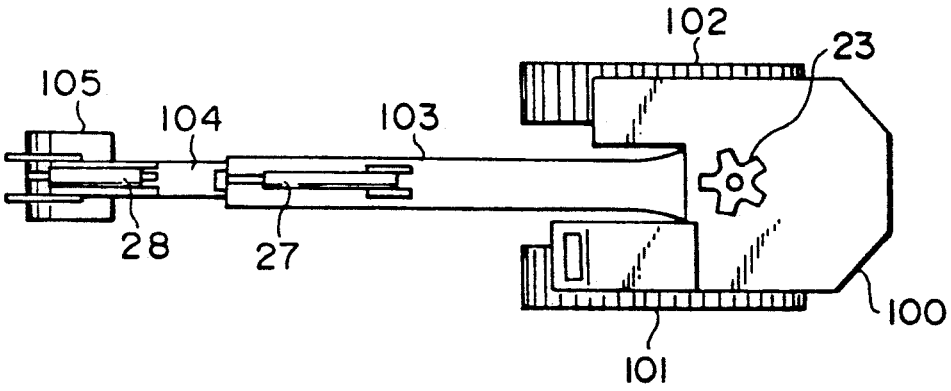
FIG. 8 is a top plan view of the hydraulic excavator.

The arrangement of operational components of the hydraulic excavator driven by the hydraulic drive system according to the embodiment is illustrated in FIGS. 7 and 8. The swing motor 23 drives a revolver 100, the left-hand travel motor 24 and the right-hand travel motor 25 drive crawler belts, or travelers 101 and 102, and the boom cylinder 26, the arm cylinder 27 and the bucket cylinder 28 drive a boom 103, an arm 104 and a bucket 105, respectively.

The operation of the embodiment constructed as above will next be described using a flow chart shown in FIG. 9. The flow chart reveals an outline of the handling procedure of the control program stored in the memory section 71.

First, as indicated in a step S1, the output signal $X_1$ of the differential-pressure detector 59, the output signal $X_2$ of the rotational-speed detector 60 and the selecting signal S from the selecting device 61 are inputted to the arithmetic section 72 through the input section 70 in the controller 62, and the differential pressure $\Delta P_{LS}$ between the pump delivery pressure $P_s$ and the maximum load pressure $P_{amax}$, the target rotational speed $N_o$ of the engine 21 and the selecting information of the selecting device 61 are read. Subsequently, the program proceeds to a step S2 where, in arithmetic section 72, it is judged whether or not the selecting device 61 is whether operated, that is, the selecting signal S is turned on. If the selecting signal S is not judged to be turned on, the metering control is unnecessary, and the program proceeds to a step S3. When the selecting signal S is not turned on and the metering control is unnecessary, then a variation in the metering range of the flow control valves 29~34 is allowed to be when the target rotational speed $N_o$ decreases and the operational amount has priority over the operability.

In the step S3, the first control force $F_1$ corresponding to the differential pressure $\Delta P_{LS}$ is obtained from the first functional relationship shown in FIG. 3 and stored in the memory section 71. In a step S4, the control signal Y corresponding to the first control force $F_1$ is outputted to the solenoid proportional pressure reducing valve 63 from the output section 73 of the controller 62. By doing so, the solenoid proportional pressure reducing valve 63 is suitably opened, and the control pressure $P_c$ corresponding to the control signal Y is loaded onto the drive sections 35c~40c of the respective pressure compensating valves 35~40, so that the control force $F_c$ corresponding to the first control force $F_1$ is generated. By doing so, when the boom directional control valve 32 and the arm directional control valve 33 are operated, for example, with the intention of the combined operation of the boom 103 and the arm 104 (refer to FIGS. 7 and 8), the control force $f-F_1$ in the valve opening direction is applied to the pressure compensating valves 38 and 39, so that the boom directional control valve 32 and the arm directional control valve 33 are controlled in pressure compensation fashion in terms of the control pressure $f-F_1$ as a target value of the differential pressure. By doing so, even when the differential pressure $\Delta P_{LS}$ is brought to a value less than the target differential pressure $\Delta P_{LSO}$, the hydraulic fluid discharged from the main pump 22 is distributed in a ratio in accordance with the opening ratio of the directional control valves 32 and 33 and is supplied to the boom cylinder 26 and the arm cylinder 27, so that simultaneous driving of the boom cylinder 26 and the arm cylinder 27, that is, a combined operation of the boom 103 and the arm 104, is conducted. Such an operation is not limited to the simultaneous driving of the boom cylinder 26 and the arm cylinder 27, but is similar for any combination of the actuators.

Figure 9:
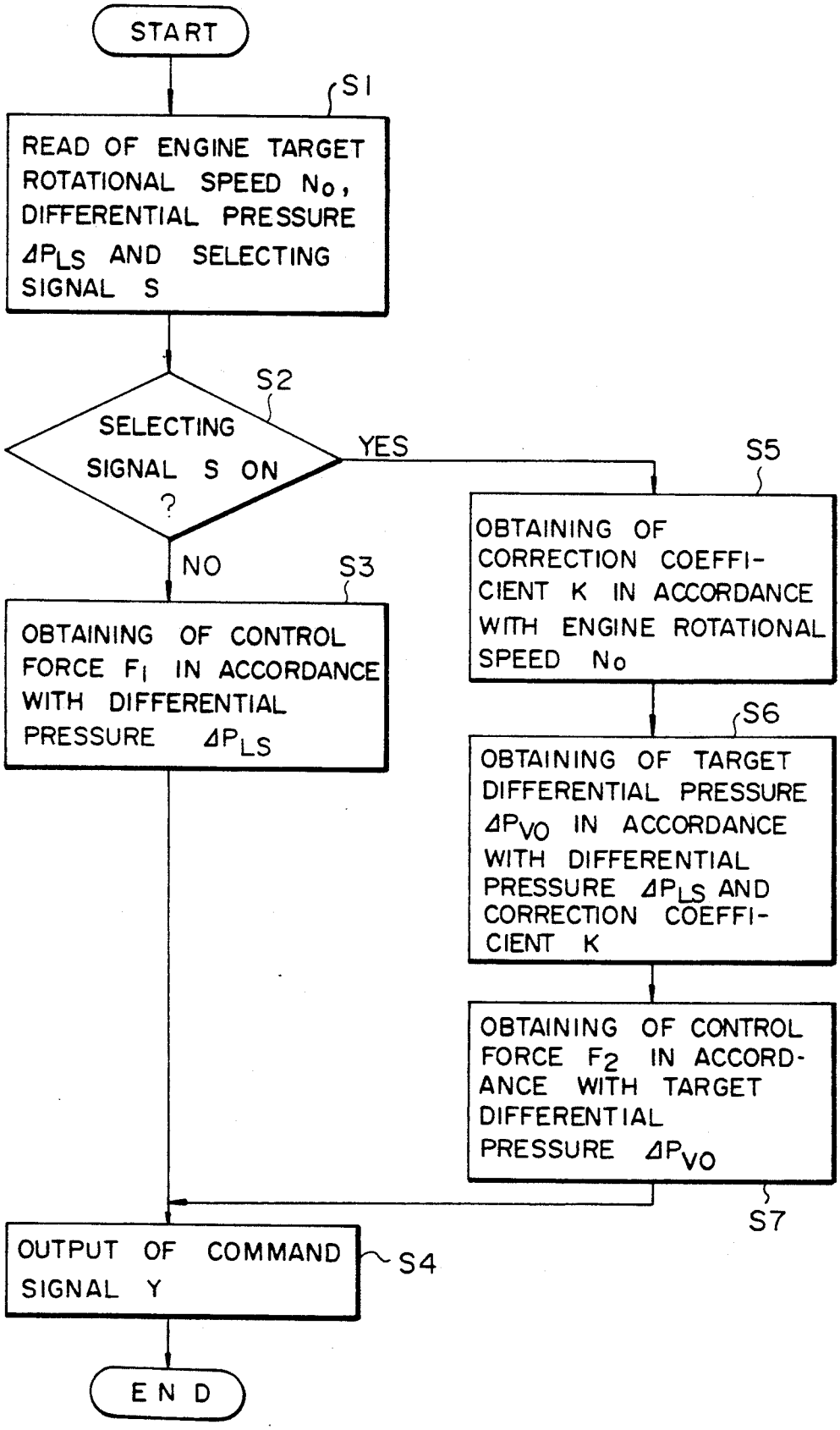
FIG. 9 is a flow chart showing calculation contents conducted by a controller.

In the step S2 shown in FIG. 9, when it is judged that the selecting signal S is turned on, or operated, the metering control, which is essential to the embodiment, is carried out by steps S5~S7 illustrated in FIG. 9.

First, as indicated in the step S5, in the arithmetic section 72 of the controller 62, the correction coefficient K corresponding to the engine target rotational speed $N_o$ is obtained from the second functional relationship shown in FIG. 4 and stored in the memory section 71. Subsequently, the program proceeds to the step S6 where the target differential pressure $\Delta P_{v0}$ of pressure compensating control corresponding to the differential pressure $\Delta P_{v0}$ and the correction coefficient K obtained in the step S5, is obtained from the third functional relationship shown in FIG. 5 and stored in the memory section 71. Moreover, the program proceeds to the step S7 where the second control force $F_2$ corresponding to the target differential pressure $\Delta P_{v0}$ obtained in the step S6, is obtained from the fourth functional relationship illustrated in FIG. 6 and stored in the memory section 71.

Subsequently, the program proceeds to the step S4 similarly to the case of the aforementioned first control force $F_1$. In the step S4, the control signal Y corresponding to the second control force $F_2$ is outputted to the solenoid proportional pressure reducing valve 63 from the output section 73 of the controller 62. By doing so, the control pressure $P_c$ corresponding to the control signal Y is loaded onto the drive sections 35c~40c of the pressure compensating valves 35~40, and the control force $F_c$ corresponding to the second control force $F_2$ is generated, so that the control force f-$F_2$ in the valve opening direction is applied to the pressure compensating valves 35~40. Accordingly, the differential pressures $\Delta P_{v1} \sim \Delta P_{v6}$ across the respective flow control valves 29~34 are controlled so as to be consistent with the target differential pressure corresponding to the control pressure f-$F_2$, or, in other words, with the target differential pressure $\Delta P_{v0}$ of pressure compensating control obtained in the step S6 from the third functional relationship shown in FIG. 5.

In this manner, the differential pressures $\Delta P_{v1} \sim \Delta P_{v6}$ of the respective flow control valves 29~34 are controlled so as to be consistent with the target differential pressure $\Delta P_{v0}$. Accordingly, even when the differential pressure $\Delta P_{LS}$ decreases less than the target differential pressure $\Delta P_{LSO}$ of load sensing control during simultaneous driving of the boom cylinder 26 and the arm cylinder 27, the target differential pressure $\Delta P_{v0}$ of pressure compensating control decreases as illustrated in FIG. 5, so that the hydraulic fluid discharged from the main pump 22 is distributed and supplied in a ratio in accordance with the opening ratios of the respective boom directional control valve 32 and the arm directional control valve 33, similarly to the case of control by the first control force $F_1$. Thus, it is possible to conduct a suitable combined operation.

When the operation is conducted with the target rotational speed $N_0$ reduced from the maximum rotational speed $N_{max}$, the constant maximum target differential pressure $\Delta P_{v0max}$ in the third functional relationship shown in FIG. 5 is reduced to a value less than $\Delta P_{max0}$ in accordance with the correction coefficient K obtained from the second functional relationship illustrated in FIG. 4. Accordingly, the differential pressures $\Delta P_{v1} \sim \Delta P_{v6}$ across the respective flow control valves 29~34 are controlled so as to decrease in accordance with a decrease in the target rotational speed $N_o$. Thus, control is conducted such that the metering range is made substantially constant. This point will next be described in further detail, using FIGS. 10 through 13.

Figure 10:
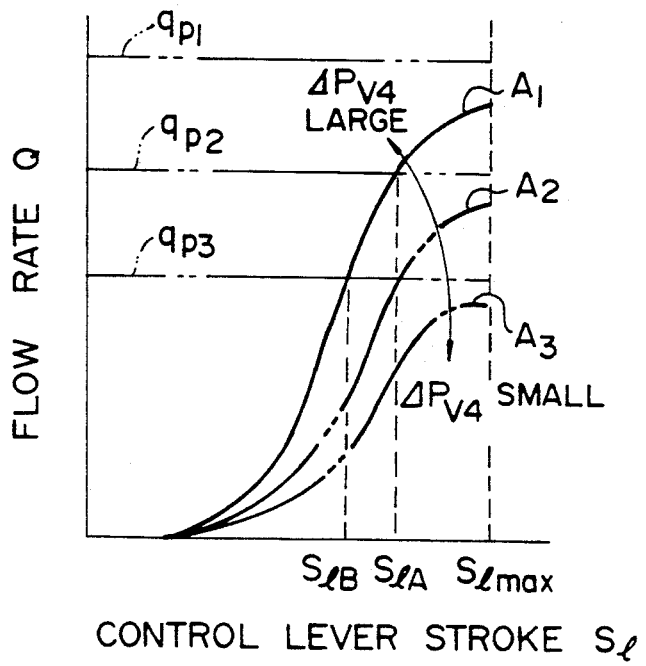
FIG. 10 is a view showing a relationship between requisite flow rate Q and a control lever stroke $S_1$ of a boom directional control valve according to the embodiment.

In FIG. 10, a characteristic line $A_1$ reveals a relationship of the requisite flow rate Q with respect to the control lever stroke $S_1$ of one flow control valve, for example, the boom directional control valve 32, when the target rotational speed $N_o$ of the engine 21 is set to the maximum rotational speed $N_{max}$ and the differential pressures $\Delta P_{v1} \sim \Delta P_{v6}$ are so controlled as to be consistent with the constant maximum target differential pressure $\Delta P_{max0}$ at the time K=1 (refer to FIG. 5).

Figure 11:
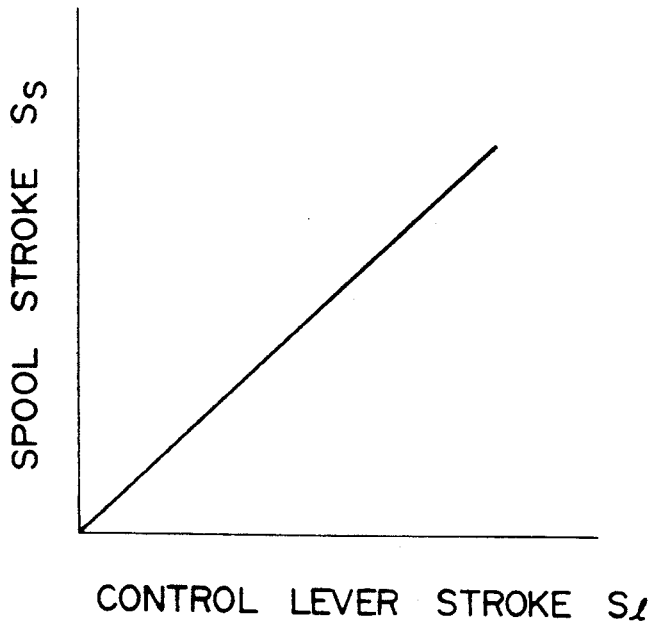
FIG. 11 is a view showing a relationship between the control lever stroke $S_1$ and a spool stroke $S_s$ of a flow control valve.
Figure 12:
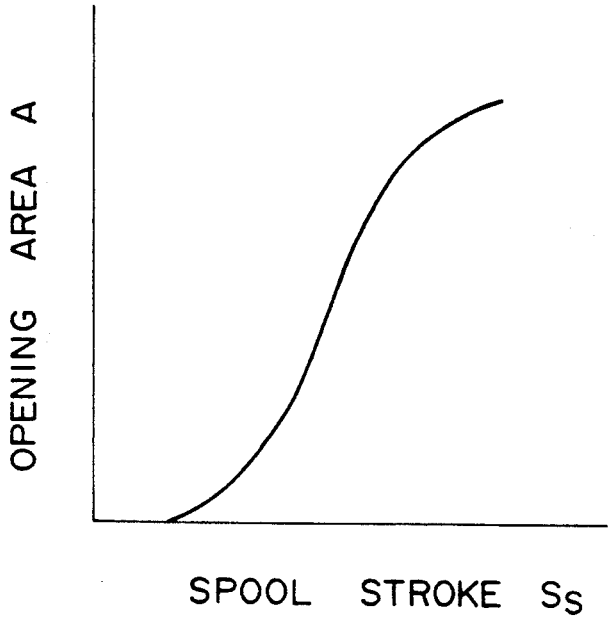
FIG. 12 is a view showing a relationship between the spool stroke $S_s$ and an opening area A of the flow control valve.
Figure 13:
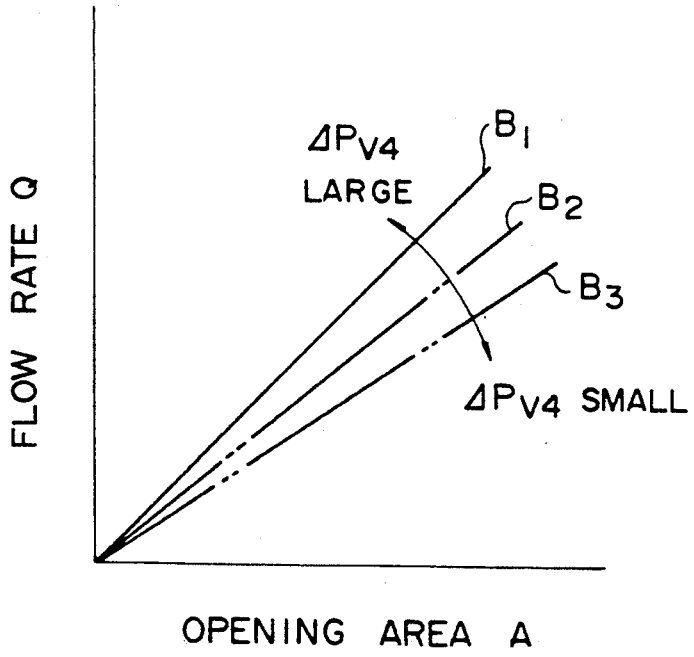
FIG. 13 is a view showing a relationship among the differential pressure, the opening area A and the requisite flow rate Q of the flow control valve.

FIG. 11 shows the relationship of a spool stroke $S_s$ with respect to the control lever stroke $S_1$ of the boom directional control valve 32. FIG. 12 illustrates the relationship of an opening area (opening) A with respect to the spool stroke $S_s$ of the boom directional control valve 32. Further, a characteristic line $B_1$ in FIG. 13 indicates the relationship of the requisite flow rate Q with respect to the opening area A when the target rotational speed $N_o$ is set to the maximum rotational speed $N_{max}$ and the differential pressure $\Delta P_{v4}$ is controlled so as to be consistent with the constant maximum target differential pressure $\Delta P_{max0}$ at the time K=1. The characteristic line $A_1$ in FIG. 10 is one in which these three relationships are composed with each other.

In the embodiment, when the target rotational speed $N_o$ of the engine 21 is reduced, for example, to $N_A$, the correction coefficient K is brought to a value $K_A$ less than 1 as shown in FIG. 4, and the constant maximum target differential pressure $\Delta P_{v0max}$ decreases accordingly as shown in FIG. 5. Thus, in the boom directional control valve 32 in which the differential pressure $\Delta P_{v4}$ is controlled so as to be consistent with the decreased target differential pressure $\Delta P_{v0max}$, the relationship of the requisite flow rate Q with respect to the opening area A varies as indicated by the characteristic line $B_2$ in FIG. 13, and the relationship of the requisite flow rate Q with respect to the control lever stroke $S_1$ varies correspondingly as indicated by the characteristic line $A_2$ in FIG. 10.

When the target rotational speed $N_o$ of the engine 21 is further reduced to a value smaller than $N_A$, for example, $N_B$, the correction coefficient K is brought to $K_B$ which is less than $K_A$, and the constant maximum target differential pressure $\Delta P_{v0max}$ decreases further. The relationship of the requisite flow rate Q with respect to the opening area A of the boom directional control valve 32 varies as indicated by the characteristic line $B_3$ in FIG. 13, and the relationship of the requisite flow rate Q with respect to the control lever stroke $S_1$ varies as indicated by the characteristic line $A_3$ in FIG. 10.

Accordingly, in case where the boom directional control valve 32 is operated with the intention of the single operation of the boom 103 (refer to FIGS. 7 and 8), the requisite flow rate Q with respect to the control lever stroke $S_1$ varies like the characteristic line $A_1$ when $N_o=N_{max}$. If the maximum available delivery rate of the main pump 22 at this time is $q_{p1}$ as shown in the figure, the passing flow rate is controlled in accordance with the characteristic line $A_1$ within substantially the entire range of the control lever stroke $S_1$, because $q_{p1}$ is larger than the maximum requisite flow rate of the boom directional control valve 32.

When the target rotational speed $N_o$ is reduced to $N_A$, the requisite flow rate Q with respect to the control lever stroke $S_1$ varies like the characteristic line $A_2$ in FIG. 10, and is reduced less than the case where $N_o=N_{max}$. Here, the constant maximum target differential pressure $\Delta P_{v0max}$ at the time K<1 is in the relationship of $\Delta P_{v0max}=K^2.\Delta P_{max0}$ with respect to the constant maximum target differential pressure $\Delta P_{max0}$ at the time K=1 as mentioned above. Further, the requisite flow rate Q of the flow control valve is expressed by the following equation, if the opening area of the flow control valve is A as described above and the differential pressure is $\Delta P_v$:

$$Q = CA\sqrt{\Delta P_v}$$

where C is a flow coefficient.

Accordingly, if the requisite flow rate of the arm directional control valve 33 at the time $N_o = N_{max}$ ($K=1$) is $Q_1$, and if the requisite flow rate at the time $N_o = N_A$ ($K = K_A$) is $Q_2$, there is a relationship of $Q_2 = K.Q_1$, so that the requisite flow rate $Q_2$ expressed by the characteristic line $A_2$ decreases at a rate of the 128 correction coefficient K with respect to the requisite flow rate $Q_2$ expressed by the characteristic line $A_1$.

Since, on the other hand, the maximum available delivery rate of the main pump 22 is the product of the displacement volume at the time the tilting angle of the swash plate 22a is maximum and the rotational speed of the engine 21, the maximum available delivery rate decreases in proportion to a decreasing ratio $N_{max}/N_A$ of the target rotational speed as shown by $q_{p2}$ in FIG. 10 if the target rotational speed $N_o$ decreases to $N_A$. The decreasing ratio $N_{max}/N_A$ at this time is equal to the correction coefficient K as seen from FIG. 4. That is, the decreasing ratio of the requisite flow rate of the characteristic line $A_2$ and the decreasing ratio of the maximum available delivery rate $q_{p2}$ are both K and equal to each other.

Accordingly, also after the target rotational speed $N_o$ has decreased to $N_A$, the characteristic line $A_2$ and the maximum available delivery rate $q_{p2}$ of the main pump 22 are maintained in relationship identical with that at the time $N_o = N_{max}$, so that it is possible to control the passing flow rate in accordance with the characteristic line $A_2$ over substantially the entire range of the control lever stroke $S_1$. For the purpose of comparison, since, conventionally, the characteristic line $A_1$ is maintained unchanged, the passing flow rate reaches its maximum when the control lever stroke is $S_{1A}$ and, subsequently, the passing flow rate does not increase even if the control lever stroke increases, so that the metering range is shortened.

In addition, when the target rotational speed $N_o$ further decreases to $N_B$, the requisite flow rate Q changes with respect to the control lever stroke $S_1$ as indicated by the characteristic line $A_3$ in FIG. 10. The decreasing ratio of the requisite flow rate with respect to the characteristic line $A_1$ is likewise K, and the decreasing ratio of the maximum available delivery rate of the main pump 22 is likewise K. Accordingly, also in this case, the relationship between the characteristic line $A_3$ and the maximum available delivery rate $q_{p3}$ of the main pump 22 after decreasing of the target rotational speed $N_o$ to $N_B$ is the same as that when $N_o = N_{max}$, so that it is possible to control the passing flow rate in accordance with the characteristic line $A_3$ over substantially the entire range of the control lever stroke $S_1$. For the purpose of comparison, since, conventionally, the characteristic line $A_1$ is maintained unchanged, the passing flow rate reaches its maximum when the control lever stroke is $S_{1B}$ and, subsequently, the passing flow rate does not increase even if the control lever stroke increases, so that the metering range is shortened.

In connection with the above, an instance of the single operation of the boom directional control valve 32 has been cited in the aforesaid description. However, it is possible to likewise control the metering range also regarding the other flow control valves.

Figure 14:
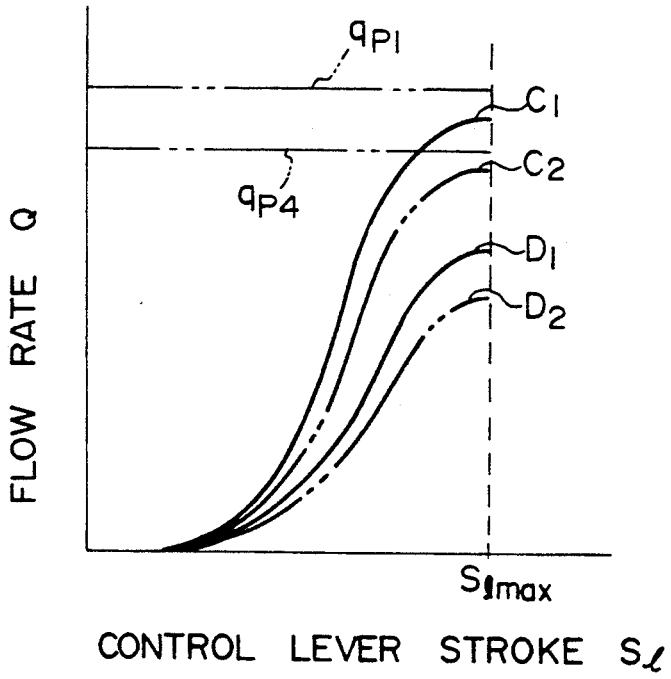
FIG. 14 is a view showing a relationship between the control lever stroke $S_1$ and the requisite flow rate Q of the boom direction control valve and an arm directional control valve according to the invention.

Furthermore, in FIG. 14, the characteristic lines $C_1$ and $D_1$ show respectively the relationships of the requisite flow rates Q with respect to the control lever strokes $S_1$ of the arm directional control valve 33 and the bucket directional control valve 34 when the target rotational speed $N_o$ of the engine 21 is at the maximum rotational speed $N_{max}$ and the differential pressures $\Delta P_{v5}$ and $\Delta P_{v6}$ are controlled so as to be consistent with the constant maximum target differential pressure $\Delta P_{max0}$ (refer to FIG. 5) when $K=1$. The characteristic lines $C_2$ and $D_2$ show respectively the relationships of the requisite flow rates Q with respect to the control lever stroke $S_1$ of the arm directional control valve 33 and the bucket directional control valve 34 when the target rotational speed $N_o$ decreases to $N_D$ so that the correction coefficient K decreases to $K_D$, and the differential pressures $\Delta P_{v5}$ and $\Delta P_{v6}$ are so controlled as to be consistent with the target differential pressure $\Delta P_{v0max}$ which decreases with reduction of K. Moreover, the maximum available delivery rate of the main pump 22 when $N_o = N_{max}$ is $q_{p1}$ as shown in the figure, and the maximum available delivery rate of the main pump 22 when $N_o = N_D$ is $q_{p4}$ as shown in the figure.

Here, assuming that the maximum requisite flow rate of the arm directional control valve 33 indicated by the characteristic line $C_1$ is 100 l/min, the maximum requisite flow rate of the bucket directional control valve 34 indicated by the characteristic line $D_1$ is 50 l/min, the pump delivery flow rate $q_{p1}$ is 120 l/min, and the pump delivery flow rate $q_{p4}$ is 90 l/min. Then, when $N_o = N_{max}$, the maximum passing flow rate of the arm directional control valve 33 is 100 l/min, and the maximum passing flow rate of the bucket directional control valve 34 is 50 l/min, since the pump delivery flow rate $q_{p1}$ is larger than the respective maximum requisite flow rates at the time the arm directional control valve 33 and the bucket directional control valve 34 are singly driven respectively, at the time $N_o = N_{max}$. Further, when the combined operation of the arm 104 and the bucket 105 is conducted which drives the arm directional control valve 33 and the bucket directional control valve 34 simultaneously, the pump delivery flow rate $q_{p1}$ is smaller than the sum of the maximum requisite flow rates and, accordingly, the differential pressure $\Delta P_{LS}$ between the pump delivery pressure $P_s$ and the maximum load pressure $P_{amax}$ tends to decrease largely less than the target differential pressure $\Delta P_{LSO}$ shown in FIG. 5. Along with the decrease in the differential pressure $\Delta P_{LS}$, the target differential pressures $\Delta P_{v0}$ of the respective pressure compensating valves 38 and 39 decrease, and the hydraulic fluid discharged from the main pump 22 is distributed and supplied at a ratio in accordance with the respective opening ratios of the arm directional control valve 33 and the bucket directional control valve 34. That is, if both the directional control valves 33 and 34 are opened to their respective maximum openings, the passing flow rate of the arm directional control valve 33 is $120 \times (\frac{2}{3}) = 80$ l/min, and the passing flow rate of the bucket directional control valve 34 is $120 \times (\frac{1}{3}) = 40$ l/min.

On the other hand, when the target rotational speed $N_o$ decreases to $N_D$ and the arm directional control valve 33 is singly driven, the decreasing ratio of the flow rate of the characteristic line $C_2$ with respect to the characteristic line $C_1$ is equal to the decreasing ratio of $q_{p4}$ with respect to the pump delivery rate $q_{p1}$ as mentioned previously. Accordingly, the maximum requisite flow rate of the characteristic line $C_2$ is $100\times(90/120)=75$ l/min. Thus, the maximum passing flow rate of the arm directional control valve 33 is 75 l/min. When the bucket directional control valve 34 is driven singly, the maximum requisite flow rate of the characteristic line $D_2$ is $50\times(90/120)=37.5$ l/min. Accordingly, the maximum passing flow rate of the bucket directional control valve 34 is 37.5 l/min. When the combined operation of the arm 104 and the bucket 105 is conducted in which the arm directional control valve 33 and the bucket directional control valve 34 are driven simultaneously, the passing flow rates of the arm and bucket directional control valves 33, 34 are $90\times(\frac{2}{3})=60$ l/min and $90\times(\frac{1}{3})=30$ l/min, respectively, due to the distributing control mentioned above, if the directional control valves 33 and 34 are opened to their respective maximum openings.

For the purpose of comparison, in the conventional case when the target rotational speed $N_o$ decreases to $N_D$, that is, when the characteristic lines $C_1$ and $D_1$ are maintained unchanged, the maximum passing flow rate of the arm directional control valve 33 is 90 l/min restricted by $q_{p4}$, and the maximum passing flow rate of the bucket directional control valve 34 is 50 l/min, when the arm directional control valve 33 and the bucket directional control valve 34 are singly driven respectively. For the combined operation, similarly to the case of the aforementioned embodiment, the passing flow rate of the arm directional control valve 33 is 60 l/min, and the passing flow rate of the bucket directional control valve 34 is 30 l/min, if the directional control valves 33 and 34 are opened to their respective maximum openings.

Accordingly, if attention is made to the passing flow rates of the bucket directional control valve 34 in the single operation and in the combined operation when the target rotational speed $N_o$ decreases to $N_D$, the passing flow rate decreases from 37.5 l/min to 30 l/min in the embodiment though, conventionally, 50 l/min decreases to 30 l/min. Thus, the decreasing ratio of the passing flow rate or the supply flow rate to the bucket cylinder 28 at the translation from the single operation to the combined operation decreases considerably. In addition, if attention is made to the ratio between the passing flow rates of the arm directional control valve 33 and the bucket directional control valve 34 in the single operation and the combined operation at the time the target rotational speed $N_o$ decreases to $N_D$, 90:50 changes conventionally to 60:30, but in the present embodiment, the ratio is maintained unchanged at 75:37.5 and 60:30.

Accordingly, in the embodiment, when the rotational speed of the prime mover decreases, the difference in flow rate characteristics between the single operation and the combined operation is reduced, so that a perception of an operability problem is reduced.

As described above, according to the embodiment, by operation of the selecting device 61, the control forces $f\text{-}F_c$ of the pressure compensating valves decrease in accordance with the decrease in the target rotational speed when the target rotational speed of the engine 21 decreases. Thus, as illustrated by the characteristic lines $A_1$, $A_2$ and $A_3$ in FIG. 10, the requisite flow rates decrease at the same ratio as the decreasing ratio of the maximum available delivery rate of the main pump 22, so that it is possible to maintain constant the metering range of the control lever stroke $S_1$ irrespective of the change in the target rotational speed. Accordingly, the metering range does not change accompanied with the change in the target rotational speed, so that there is provided a superior operability which does not indicate a problem to an operator.

Furthermore, as illustrated by the characteristic line $A_3$ in FIG. 10, when the engine target rotational speed is reduced and the pump delivery rate is reduced, the requisite flow rate changes correspondingly, and the changing ratio of the requisite flow rate of the flow control valve with respect to the control lever stroke $S_1$ decreases. Thus, it is possible to conduct the flow rate adjustment by the small gain within the metering range which is large relatively, and it is possible to easily conduct a precise an operation such as the leveling orthopedic operation of the ground.

Further, when the target rotational speed $N_o$ is reduced, a change in the passing flow rate of the flow control valve on the side of the smaller-capacity actuator in the single operation and in the combined operation is reduced, and a change in the ratio of the passing flow rate of the same flow control valve during translation from the single operation to the combined operation and vice versa is reduced. Accordingly, a difference in flow characteristic between the single operation and the combined operation is reduced, so that it is possible to reduce the perception of an operability problem.

Moreover, in the embodiment, the target rotational speed $N_o$, not the actual rotational speed of the engine 21, is used in control of the control forces $f\text{-}F_c$ of the aforesaid pressure compensating valves. Accordingly, it is possible to conduct control in accordance with the output characteristic of the engine 21. It is also possible to conduct steady control, since no fluctuation occurs in the control force $f\text{-}F_c$ accompanied with fluctuation in the detecting value which will occur in the use of the actual rotational speed.

Modification of Correction Coefficient Characteristic

Figure 15:
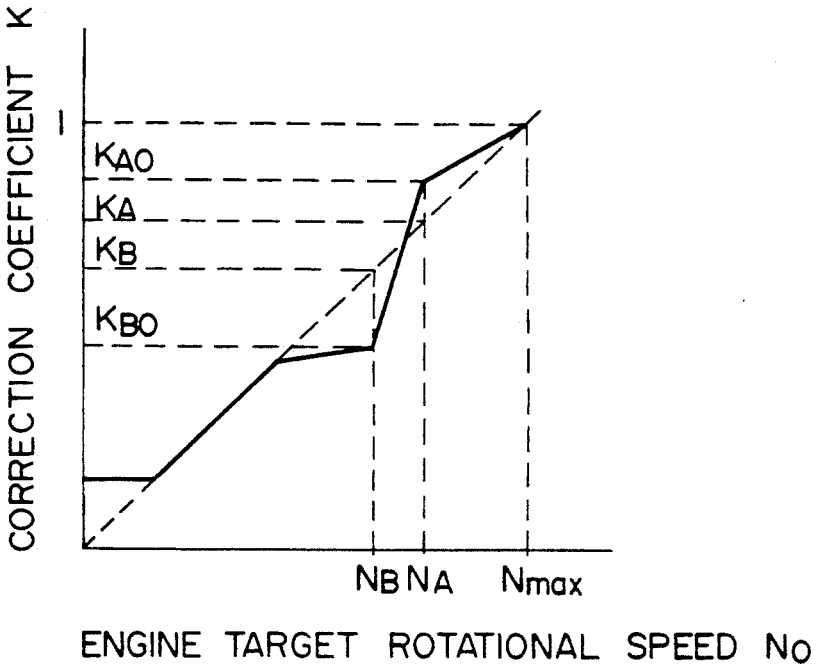
FIG. 15 is a view showing a second functional relationship between the correction coefficient K and the target rotational speed $N_0$ of the engine according to another embodiment of the invention.

A second embodiment of the invention will be described with reference to FIGS. 15 and 16. The embodiment is such that the relationship between the engine target rotational speed $N_o$ and the correction coefficient K is differentiated from the first embodiment.

That is, in the relationship shown in FIG. 4 of the first embodiment, the correction coefficient K the target rotational speed $N_o$ decrease in the same ratio. In the embodiment shown in FIG. 15, the decreasing ratio of the correction coefficient K is differentiated from the decreasing ratio of the target rotational speed $N_o$ within a predetermined range of the engine target rotational speed $N_o$. Particularly, for a target rotational speed $N_A$ of moderate order which is common when an operation is conducted with an eye toward economical efficiency, the correction coefficient $K_A$ is made larger than the decreasing ratio $N_A/N_{max}$ of the target rotational speed. For the low target rotational speed $N_B$ which is common when an operation is conducted with an eye toward precise operation, the correction coefficient $K_{BO}$ is reduced less than the decreasing ratio $N_B/N_{max}$ of the target rotational speed.

Figure 16:
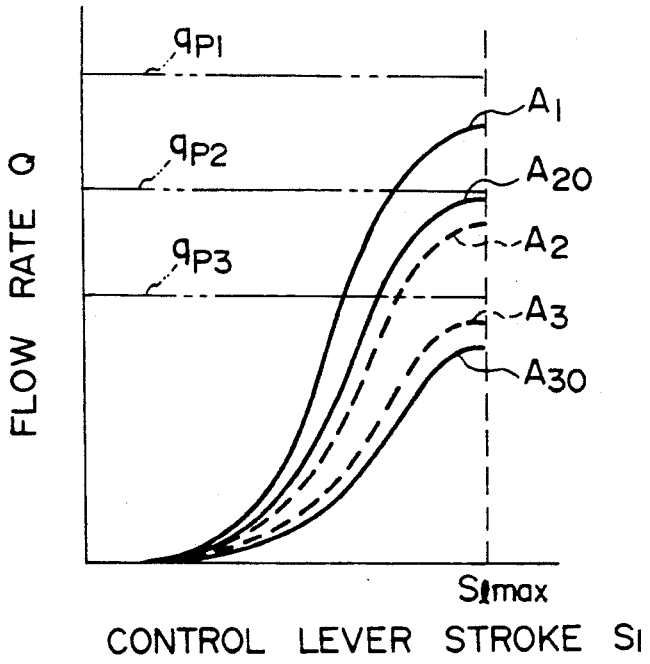
FIG. 16 is a view showing a relationship between the control lever stroke $S_1$ and the requisite flow rate Q of the boom directional control valve according to the embodiment.

The relationship between the control lever stroke $S_1$ and the requisite flow rate Q of one flow control valve, for example, the boom directional control valve 32, when the relationship between $N_o$ and K is set in this manner, is shown in FIG. 16. In the embodiment, as shown in FIG. 15, when the target rotational speed $N_o$ of the engine 21 is reduced to, for example, $N_A$, the correction coefficient K is brought to $K_{AO}$ which is larger than $K_A$ ($=N_A/N_{max}$), and the constant maximum target differential pressure $\Delta P_{vOmax}$ illustrated in FIG. 5 increases correspondingly more than for the case of $K=K_A$. Accordingly, in the boom directional control valve 32 in which the differential pressure $\Delta P_4$ is controlled so as to be consistent with the target differential pressure $\Delta P_{vOmax}$, the relationship of the requisite flow rate Q with respect to the control lever stroke $S_1$ changes as indicated by the characteristic line $A_{20}$ in FIG. 16. For the purpose of comparison, the characteristic line $A_2$ at the time $K=K_A$ is indicated by the dotted line.

Furthermore, the target rotational speed $N_o$ further decreases to $N_B$, the correction coefficient K is brought to $K_{BO}$ which is smaller than $K_B$ ($=N_B/N_{max}$), and the constant maximum target differential pressure $\Delta P_{vOmax}$ is reduced less than for the case where $K=K_B$. Accordingly, the relationship of the requisite flow rate Q with respect to the control lever stroke $S_1$ changes as indicated by the characteristic line $A_{30}$ in FIG. 16. For the purpose of comparison, the characteristic line $A_3$ at the time $K=K_B$ is indicated by the dotted line.

Other constructions are the same as those of the first embodiment described above.

The embodiment is constructed as mentioned above. Accordingly, by operation of the selecting device 61 (refer to FIG. 1), when the target rotational speed of the engine 21 is reduced, the requisite flow rate Q decreases at substantially the same ratio as the decreasing ratio of the maximum available delivery rates $q_{p1}$, $q_{p2}$ and $q_{p3}$ of the main pump 22 as illustrated by the characteristic lines $A_1$, $A_{20}$ and $A_{30}$ in FIG . 16. Thus, it is possible to obtain advantages similar to those of the first embodiment. Further, when the target rotational speed is reduced to $N_A$, the requisite flow rate increases slightly more than for the case of the first embodiment, so that the supply flow rate to the actuator increases. Thus, the operating amount per unit fuel which is consumed by the engine 21 increases so that it is possible to improve the economic efficiency. Moreover, when the target rotational speed is reduced to $N_B$, the requisite flow rate is reduced slightly less than for the case of the first embodiment, and the supply flow rate to the actuator is reduced. Thus, there can be provided a flow rate characteristic which is more suitable for precise operation.

Modification of Delivery-rate Control Device

Still another embodiment of the invention will be described with reference to FIGS. 17 and 18. These embodiments are differentiated from the first embodiment in the construction of the delivery-rate control device of the main pump 22.

Figure 17:
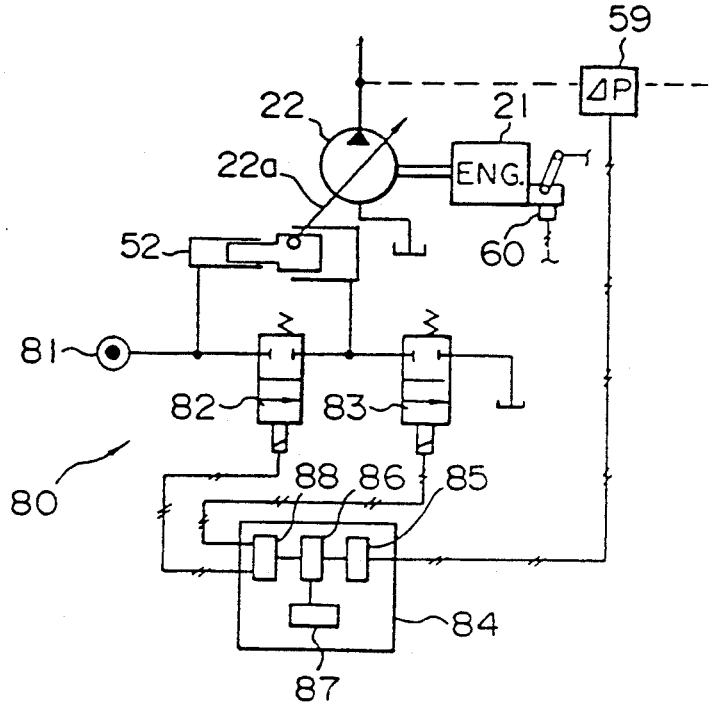
FIG. 17 is a view showing a modification of a delivery-rate control unit.

That is, in FIG. 17, a delivery-rate control device 80 in this embodiment comprises a solenoid valve 82 connected to a hydraulic-fluid source 81 and connected between a hydraulic chamber on the head side of the drive cylinder device 52 and a hydraulic chamber on the rod side thereof, a solenoid valve 83 connected between the solenoid valve 82 and a tank and connected to the hydraulic chamber on the head side of the drive cylinder device 52, and a second controller 84 for these solenoid valves 82 and 83.

The controller 84 comprises an input section 85, an arithmetic section 86, a memory section 87 and an output section 88. Inputted to the input section 85 is a signal from the differential-pressure detector 59 which detects the differential pressure $\Delta P_{LS}$ between the maximum load pressure $P_{amax}$ and the delivery pressure $P_s$ of the main pump 22.

Stored in the memory section 87 of the controller 84 is the desired differential pressure between the pump delivery pressure $P_s$ and the maximum load pressure $P_{amax}$, which is the differential pressure which corresponds to the target differential pressure $\Delta P_{LSO}$ set by the spring 54 of the delivery-rate control device 41 in the first embodiment described above. The target differential pressure $\Delta P_{LSO}$ and the actual differential pressure $\Delta P_{LS}$ detected by the differential-pressure detector 59 are compared with each other. A drive signal in accordance with the difference between the target differential pressures $\Delta P_{LSO}$ and the actual differential pressure $\Delta P_{LS}$ is selectively outputted from the output section 88 to the solenoid valves 82 and 83.

Here, assuming that the differential pressure $\Delta P_{LS}$ detected by the differential-pressure detector 59 is larger than the target differential pressure $\Delta P_{LSO}$, the drive signal is outputted from the controller 84 to the solenoid valve 82 so that the solenoid valve 82 is switched to its open position. Thus, the hydraulic fluid from the hydraulic-fluid source 81 is supplied to both the hydraulic chambers on the side of the rod and on the side of the head of the drive cylinder device 52. At this time, the difference in pressure receiving area between the hydraulic chamber on the head side of the drive cylinder device 52 and the hydraulic chamber on the rod side thereof causes the piston of the drive cylinder device 52 to move in the left-hand direction shown in the figure. The swash plate 22a is driven such that the flow rate discharged from the main pump 22 decreases. Thus, the pump delivery rate is controlled such that the differential pressure $\Delta P_{LS}$ approaches the target differential pressure $\Delta P_{LSO}$. Further, when the differential pressure $\Delta P_{LS}$ detected by the differential-pressure detector 59 is smaller than the target differential pressure $\Delta P_{LSO}$, a signal is outputted from the controller 84 to the drive section of the solenoid valve 83 so that the solenoid valve 85 is switched to its open position. The hydraulic chamber on the head side of the drive cylinder device 52 and the tank communicate with each other. The hydraulic fluid of the hydraulic-fluid source 81 is supplied to the hydraulic chamber on the rod side of the drive cylinder device 52. The piston of the drive cylinder device 52 moves to the right-hand direction in the figure. The swash plate 22a is driven such that the flow rate discharged from the main pump 22 increases. Thus, the delivery rate is controlled such that the differential pressure $\Delta P_{LS}$ approaches the target differential pressure $\Delta P_{LSO}$.

Other constructions are the same as those of the first embodiment mentioned previously.

Also in the embodiment constructed as above, it is possible to load-sensing-control the main pump 22 similarly to the first embodiment. Since, further, other constructions are the same as those of the first embodiment, there can be provided advantages similar to those of the first embodiment.

Figure 18:
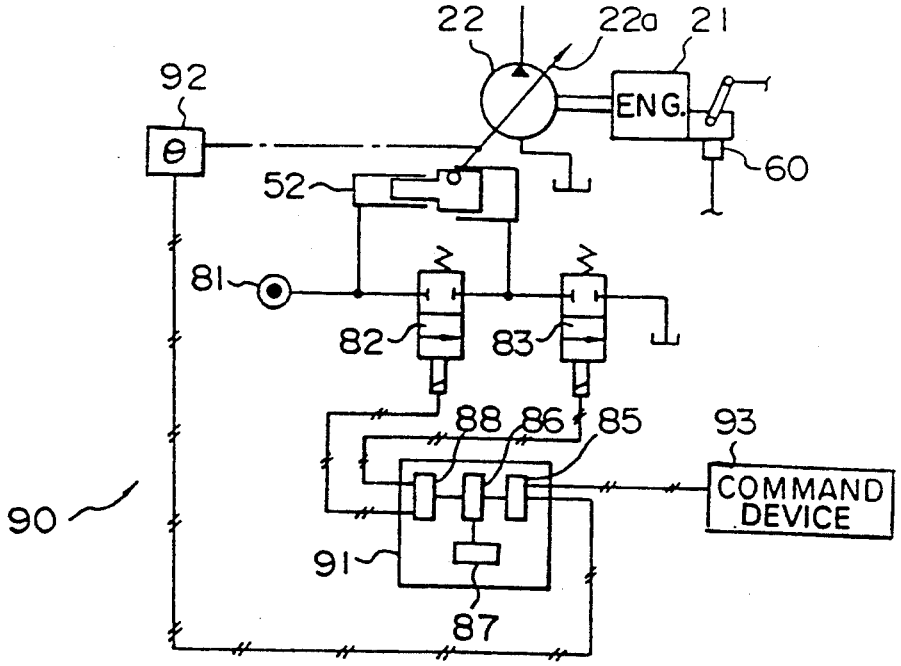
FIG. 18 is a view showing another modification of the delivery-rate control unit.

Moreover, in FIG. 18, a delivery-rate control device 90 for the main pump 22 of the embodiment comprises a hydraulic-fluid source 81, solenoid valves 82 and 83 and a controller 91, which are equivalent to those of the embodiment shown in FIG. 17. The delivery-rate control device 90 further comprises a tilting-angle detector 92 for detecting a tilting angle of the swash plate 22*a* of the main pump 22, and a command device 93 which is operated by an operator to command the target delivery rate of the main pump 22, or target tilting angle. Respective signals from the tilting-angle detector 92 and the command device 93 are inputted to the input section 85 of the controller 91. The command device 93 commands the target tilting angle such that the delivery rate can be obtained correspondingly to the total requisite flow rate of the flow control valves at this time.

In the controller 91, a value of the target tilting angle commanded by the command device 93 and a value of the actual tilting angle detected by the tilting-angle detector 92 are compared with each other at the arithmetic section 86. A drive signal corresponding to the difference of the comparison is selectively outputted from the output section 88 to the drive sections of the respective solenoid valves 82 and 83. The tilting angle of the swash plate 22*a* is so controlled as to obtain the delivery rate in accordance with the command value of the command device 93.

In the embodiment constructed in this manner, the delivery rate of the main pump 22 is not load-sensing-controlled, but can be controlled in accordance with the command value of the command device 93. Since other constructions are the same as those of the first embodiment, there can be provided advantages similar to those of the first embodiment.

Modification of Control Pressure Generating Means

A further embodiment of the invention will be described with reference to FIG. 19. The embodiment is different in construction of the control-pressure generating means from the first embodiment, but other constructions are the same as those of the first embodiment.

Figure 19:
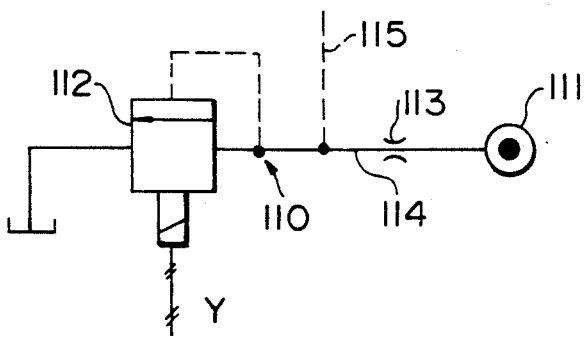
FIG. 19 is a view showing a modification of a pressure generating means.

In FIG. 19, control-pressure generating means 110 of the embodiment is constructed as follows. The control-pressure generating means 110 includes a pilot hydraulic-fluid source 111, a variable relief valve 112 interposed between the pilot hydraulic-fluid source 111 and a tank and operated in response to the control signal Y outputted from the controller 62 illustrated in FIG. 1, and a throttle valve 113 interposed between the variable relief valve 112 and the pilot hydraulic-fluid source 111. A line 114 between the variable relief valve 112 and the restrictor valve 113 communicates with the drive sections 35*c*~40*c* of the respective pressure compensating valves 35~40 shown in FIG. 1 through a pilot line 115.

Also in the embodiment constructed as above, the setting pressure of the variable relief valve 112 varies dependent upon the control signal Y outputted from the controller 62. Control pressure is generated which suitably modifies the magnitude of the pilot pressure outputted from the pilot hydraulic-pressure source 111, and is introduced to the drive section 35*c*~40*c* of the respective pressure compensating valves 35~40. Accordingly, the control-pressure generating means 110 can function equivalently to the solenoid proportional pressure reducing valve 63 in the first embodiment, and there can be provided advantages similar to those of the first embodiment.

Modification 1 of the Pressure Compensating Valve

A further embodiment of the invention will be described with reference to FIGS. 20 through 22. In the embodiment, the construction of drive means for the pressure compensating valve is modified, but other constructions are the same as those of the first embodiment.

Figure 20:
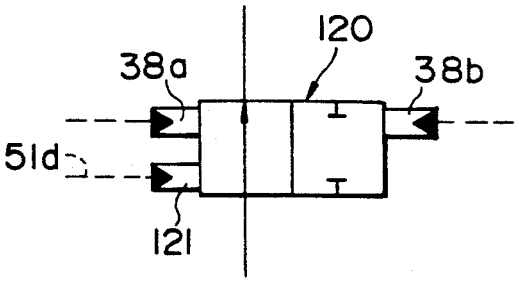
FIG. 20 is a view showing a modification of a drive means of a pressure compensating valve.

FIG. 20 shows a construction of the pressure compensating valve according to the embodiment. The presssure compensating valve 120 is constructed as follows. The pressure compensating valve 120 is provided for the boom directional control valve 32, for example. As the drive means which sets a target value of the differential pressure $\Delta P_{v4}$, a single drive section 121 is provided in substitution for the spring 48 and the drive section 38*c* of the first embodiment. The control pressure $P_c$ is introduced to the drive section 121 through the pilot line 51*d*, to apply the control force $F_c$ in the valve opening direction to the pressure compensating valve 120. Although not shown, similar pressure compensating valves are provided respectively for other flow control valves.

In the embodiment which utilizes the pressure compensating valve 120 of this kind, the direction of the control force $F_c$ applied by the drive section 121 is different from that of the first embodiment. Accordingly, among the functional relationships stored in the memory section 71 of the controller 62 shown in FIG. 1, the first functional relationship for obtaining a first control force $F_1$ from the differential pressure $\Delta P_{LS}$ between the pump delivery pressure and the maximum load pressure, and a fourth functional relationship for obtaining a second control force $F_2$ from the target differential pressure $\Delta P_{v0}$ from the third functional relationship illustrated in FIG. 5, are different from those shown in FIGS. 3 and 6.

Figure 21:
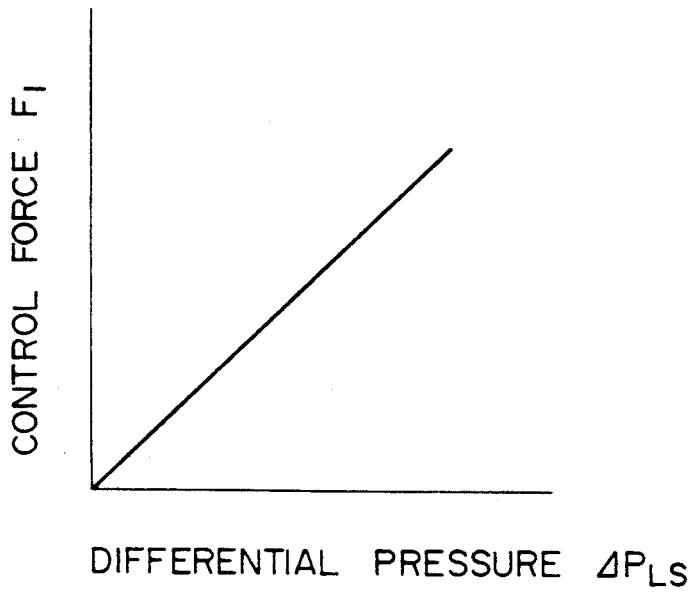
FIG. 21 is a view showing a first functional relationship between the differential pressure $\Delta P_{LS}$ and the first control force $F_1$ for the pressure compensating valve illustrated in FIG. 20.

In the first functional relationship which obtains the first control force $F_1$ from the differential pressure $\Delta P_{LS}$ the control force $F_1$ decreases in accordance with a decrease in the differential pressure $\Delta P_{LS}$ as shown in FIG. 21. Further, in the fourth functional relationship, which obtains the second control force $F_2$ from the target differential pressure $\Delta P_{v0}$, the control force $F_2$ decreases in accordance with a decrease in the target differential pressure $\Delta P_{v0}$.

In the embodiment constructed in this manner, when the selecting device 61 shown in FIG. 1 is not operated, the first control force $F_1$ is obtained from the functional relationship illustrated in FIG. 21 in accordance with the differential pressure $\Delta P_{LS}$ which is detected by the differential-pressure detector 59. The control pressure $P_c$ equivalent to this first control force $F_1$ is introduced to the drive section 121 of the pressure compensating valve 120. The control force $F_c$ in the valve opening direction, which is equivalent to the first control force $F_1$, is applied to the pressure compensating valve 120. The boom directional control valve 32 is pressure-compensating-controlled in terms of the control force $F_1$ as a target value of the differential pressure. In other words, the pressure compensating valve 120 is controlled in a manner similar to a conventional one.

Further, when the selecting device 61 is operated to output the signal S, the correction coefficient K is obtained from the second functional relationship shown in FIG. 4, in accordance with the engine target rotational speed $N_o$, similarly to the first embodiment. The target differential pressure $\Delta P_{v0}$ is obtained from the third functional relationship shown in FIG. 5, in accordance with the correction coefficient K and the differential pressure $\Delta P_{LS}$. The second control force $F_c$ is obtained from the fourth functional relationship shown in FIG. 22, in accordance with the target differential pressure $\Delta P_{v0}$. The control pressure $P_c$ corresponding to the second control force $F_2$ is introduced to the drive section 121 of the pressure compensating valve 120. The control force $F_c$ in the valve opening direction, which corresponds to the second control force $F_2$, is applied to the pressure compensating valve 120. The boom directional control valve 32 is pressure-compensation-controlled in terms of the control force $F_2$ as the target value of the differential pressure.

Also in the embodiment constructed in a manner as described above, by operation of the selecting device 61, the control force $F_c$ of the pressure compensating valve decreases in accordance with a decrease in the target rotational speed, when the target rotational speed of the engine 21 decreases. Accordingly, it is possible to obtain the relationship between the requisite flow rate Q and the control lever stroke $S_1$ as indicated by the characteristic lines $A_1$, $A_2$ and $A_3$ and $C_1$, $C_2$, $D_1$ and $D_2$ in FIGS. 10 and 14. Similarly to the first embodiment, the metering range of the control lever stroke $S_1$ is made constant irrespective of a change in the target rotational speed. Thus, the operability is made superior, and a precise operation can be made easy. Further, there are also advantages which improve the operation perception on translation from the single operation to the combined operation, and vice versa.

Particularly, in the embodiment, since no spring is necessary for setting the target differential pressure of the pressure compensating valve, the construction can be made simple and, accordingly, the manufacturing errors can be made small, and there can be provided a superior construction for control accuracy.

Modification 2 of Pressure Compensating Valve

Still another embodiment of the invention, in which the drive means of the pressure compensating valve is further modified, will be described with reference to FIGS. 23 and 24.

Figure 23:
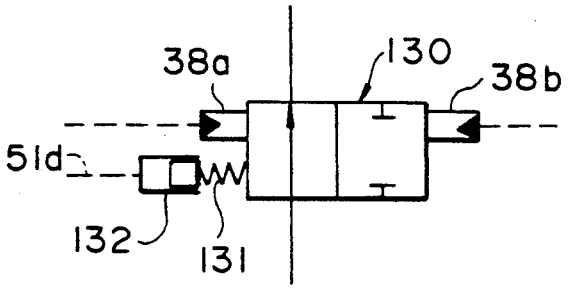
FIG. 23 is a view showing another modification of the drive means of the pressure compensating valve.

In FIG. 23, a pressure compensating valve 130 of the embodiment is provided for the boom directional control valve 32, for example. As the drive means for setting a target value of the differential pressure $\Delta P_{v4}$, in substitution for the spring 48 and the drive section 38*c* of the first embodiment, there are provided a spring 131 for giving biasing force in the valve opening direction to the distributing-flow compensating valve 130, and a drive section 132 which generates the control force $F_c$ acting in a contraction direction of the spring 131 in accordance with the control pressure $P_c$ introduced through the pilot line 51*d*, to control a pre-set force of the spring 131. Similar pressure compensating valves are provided also with respect to the other resepective flow control valves.

Figure 22:
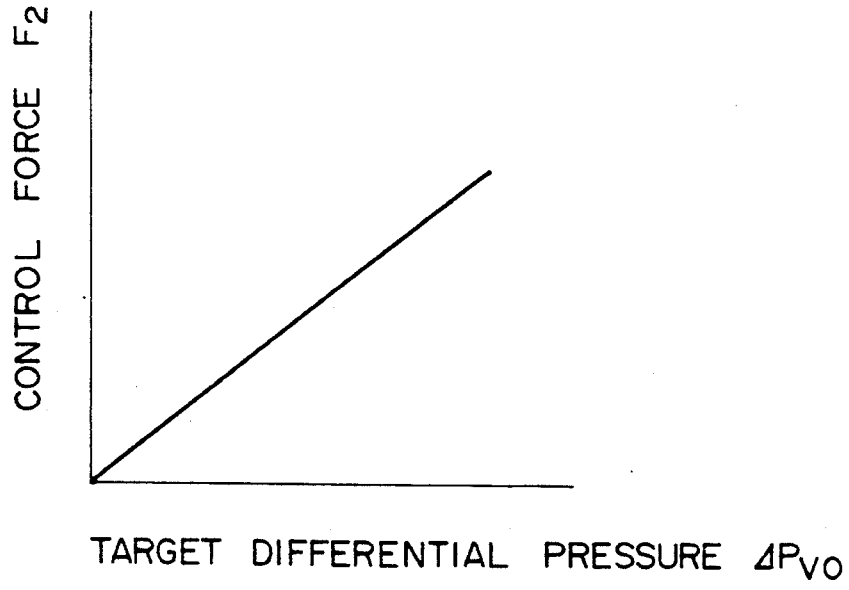
FIG. 22 is a view showing a fourth functional relationship between the target differential pressure $\Delta P_{v0}$ and a second control force $F_2$ for the pressure compensating valve.

Stored in the memory section 71 of the controller 62 illustrated in FIG. 1 is a functional relationship which corrects a portion of an initial pre-set force of the spring 131 from the first and second control forces $F_1$ and $F_2$ of the functional relationships shown in FIGS. 21 and 22 described above, as the first functional relationship obtaining the first control force $F_1$ from the differential pressure $\Delta P_{LS}$ and as the fourth functional relationship obtaining the second control force $F_2$ from the target differential pressure $\Delta P_{v0}$.

In the embodiment constructed in this manner, similarly to the embodiment mentioned previously, the control pressure $P_c$ equivalent to the first control force $F_1$ obtained from the differential pressure $\Delta P_{LS}$ is loaded onto the drive section 132 when the selecting device 61 is not operated. When the selecting device 61 is operated, the control pressure $P_c$ equivalent to the second control force $F_2$ obtained from the target differential pressure $\Delta P_{v0}$ is loaded onto the drive section 132, so that the control force $F_c$ is generated. The pre-set force of the spring 131 is suitably adjusted correspondingly. The boom directional control valve 32 is pressure-compensating-controlled in terms of this adjusted pre-set force as a target value of the differential pressure. Accordingly, also in the embodiment, there can be obtained advantages similarly to those of the first embodiment.

In the embodiment, particularly, since the pressure receiving area of the drive section 132, which is variable in pre-set force, it set regardless of the drive section 38*a* of the pressure compensating valve 130, there can be obtained advantages in which a degree of freedom of design and manufacturing increases.

Figure 24:
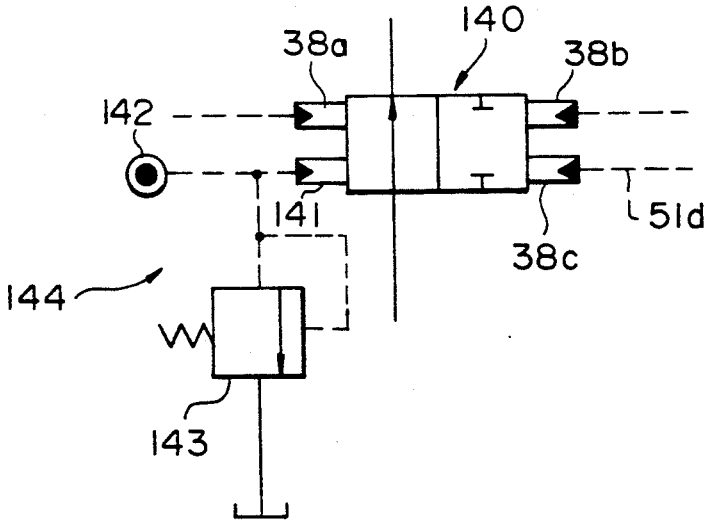
FIG. 24 is a view showing another modification of the pressure compensating valve.

Further, in FIG. 24 showing another embodiment of the drive means of the pressure compensating valve, the pressure compensating valve 140 is constructed as follows. The pressure compensating valve 140 is provided for the boom directional control valve 32, for example. As the drive means which sets a target value of the differental pressure $\Delta P_{v4}$, a hydraulic drive section 141 is provided in substitution for the spring 48 of the first embodiment. Pilot-pressure generating means 144 is provided which generates a constant pilot pressure restricted by a relief valve 143 on the basis of the hydraulic fluid from a hydraulic-pressure source 142 and loads the constant pilot pressure onto the drive section 141. Athough not shown, drive means of other respective pressure compensating valves are likewise constructed. The constant pilot pressure of the pilot-pressure generating means 144 is commonly loaded onto the drive sections in substitution for these springs.

In the embodiment, functional relationships similar to those of the first embodiment shown in FIGS. 3 through 6 are stored in the memory section 71 of the controller 62 illustrated in FIG. 1.

In the embodiment constructed in this manner, there are obtained advantages similar to those of the first embodiment and, in addition thereto, since the constant pilot pressure generated at the pilot-pressure generating means 144 is commonly loaded onto the drive sections of the entire pressure compensating valves, it is possible to prevent the control accuracy from being lowered due to variation of the springs, and it is possible to provide a superior construction for control accuracy.

Another Embodiment

Still another embodiment of the invention will be described with reference to FIG. 25. In the figure, members identical with those shown in FIG. 1 will be designated by the same reference numerals.

Figure 25:
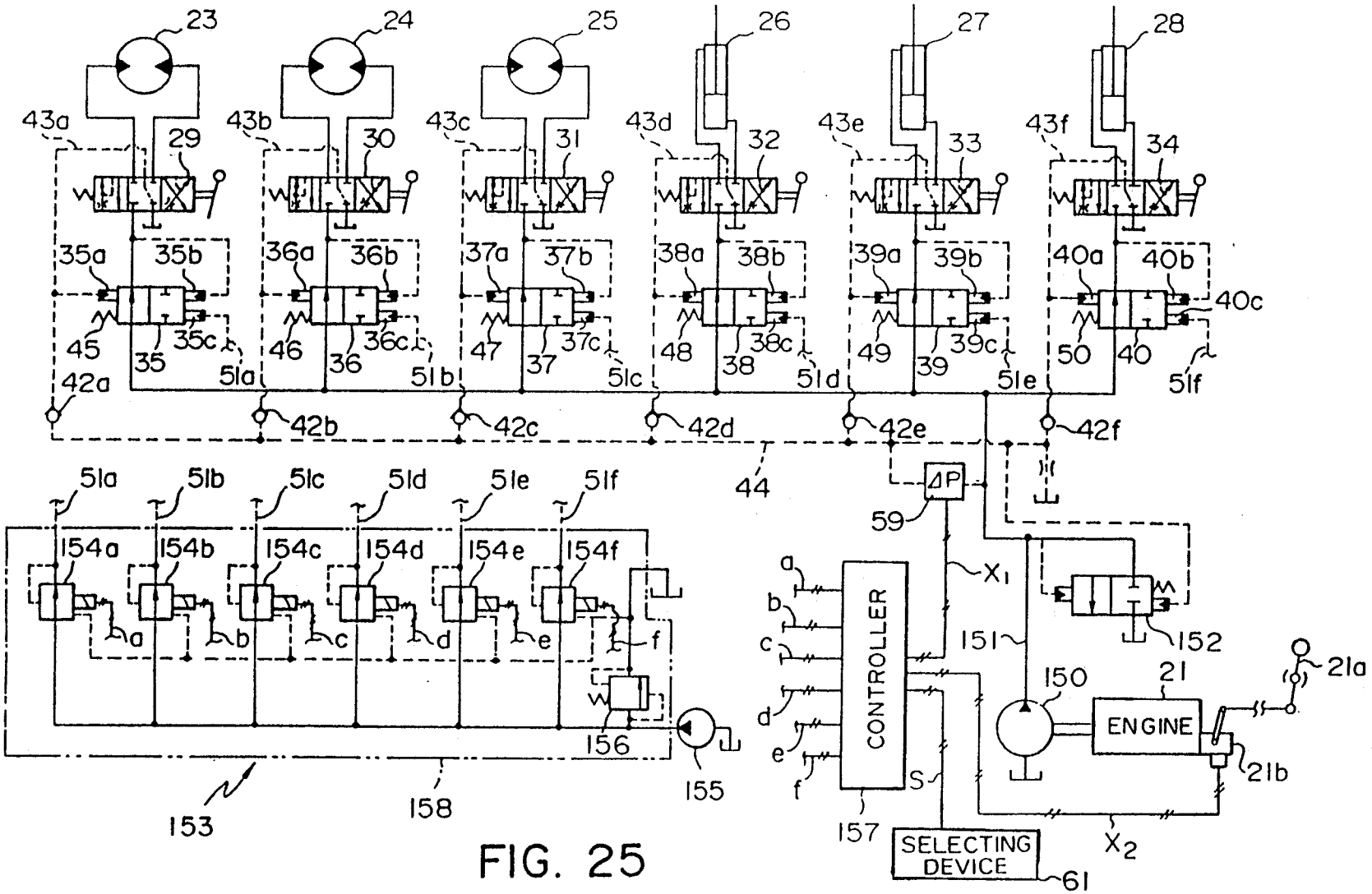
FIG. 25 is a schematic view showing an entire construction of a hydraulic drive system according to another embodiment of the invention.

In FIG. 25, a main pump 150 is a hydraulic pump of constant displacement type. An unload valve 152 driven in accordance with the differential pressure $\Delta P_{LS}$ between the pump delivery pressure $P_s$ and the maximum load pressure $P_{amax}$ is connected to a delivery line 151 of the main pump 150, so that the differential pressure $\Delta P_{LS}$ is maintained at a predetermined value, and when the load pressure is zero or small, the pump delivery pressure is made small correspondingly and the load on the engine 21 is released.

Moreover, control-pressure generating means 153 comprises six solenoid proportional pressure reducing valves 154*a*, 154*b*, 154*c*, 154*d*, 154*e* and 154*f* which are provided correspondingly to the respective pressure compensating valves 35~40, a pilot pump 155 for supplying the hydraulic fluid to these solenoid proportional pressure reducing valves 154*a*~154*f*, and a relief valve 156 which regulates the pressure of the hydraulic fluid supplied from the pilot pump 155 to generate a constant pilot pressure. The solenoid proportional pressure reducing valves 154*a*~154*f* communicate respectively with the drive sections 35*c*~40*c* of the respective pressure compensating valves 35~40 through the pilots 51*a*~51*f*. Further, the solenoid proportional pressure reducing valves 154*a*~154*f* are driven respectively by control signals a, b, c, d, e and f which are outputted from a controller 157.

In the control-pressure generating means 153, the solenoid proportional pressure reducing valves 154*a*~154*f* and the relief valve 156 are preferably constructed as a single block assembly, as indicated by the double dotted line 158.

A construction of the controller 157 is similar to that of the first embodiment. Stored in a memory section of the controller 157 are functional relationships which individually calculate first control forces $F_{1a}$~$F_{1f}$ when the selecting device 61 is not operated, and which individually calculate second control forces $F_{2a}$~$F_{2f}$ when the selecting device 61 is operated, correspondingly to the respective solenoid proportional pressure reducing valves 154*a*~154*f*.

For instance, six functional relationships between the differential pressure $\Delta P_{LS}$ and the first control forces $F_{1a}$~$F_{1f}$ are stored in correspondence to the first functional relationship shown in FIG. 1 of the first embodiment. Further, six functional relationships between the target rotational speed $N_o$ and the correction coefficients $K_a$~$K_f$ are stored in correspondence to the second functional relationship shown in FIG. 4 of the first embodiment. Moreover, stored are functional relationships corresponding to the third and fourth functional relationships illustrated in FIGS. 5 and 6 of the first embodiment, which are functional relationships which can obtain the second control forces $F_{2a}$~$F_{2f}$ in accordance with correction coefficients $K_a$~$K_f$. The functional relationship shown in FIG. 4, the functional relationship shown in FIG. 15 and the functional relationship in which even if the target rotational speed $N_o$ changes, the correction coefficient K is maintained 1 (one), for example, may be included as the six functional relationships between the target rotational speed $N_o$ and the correction coefficients $K_a$~$K_f$.

In the controller 157, the first control forces $F_{1a}$~$F_{1f}$ or the second control forces $F_{2a}$~$F_{2f}$, which are calculated by the use of the above-mentioned functional relationships, are outputted as the control signals a, b, c, d, e and f. In the solenoid proportional pressure reducing valves 154*a*~154*f*, control pressures $P_{c1}$~$P_{c6}$ corresponding respectively to the control signals are generated, and are loaded respectively onto the drive sections 35*c*~40*c* of the respective pressure compensating valves 35~40.

In the embodiment constructed in this manner, when the target rotational speed of the engine 21 is reduced by operation of the selecting device 61, the control forces f-$F_{c1}$~f-$F_{c6}$ in the valve opening direction are reduced individually and/or only in the specific pressure compensating valve in accordance with the six functional relationships between the target rotational speed $N_o$ and the correction coefficients $K_a$~$K_f$. Accordingly, regarding the pressure compensating valve in which the control force is reduced, the metering range of the control lever stroke $S_l$ is made substantially constant regardless of a change in the target rotational speed, similarly to the first embodiment. Thus, operability can be made superior, and precise operation can be made easy. Further, there are advantages in which the perceived operation is improved at translation from the simple operation to the combined operation or vice versa. Moreover, regarding the pressure compensating valve which utilizes the functional relationship shown in FIG. 15, there can be provided advantages in which, when the target rotational speed is reduced to $N_A$, the requisite flow rate is slightly increased more than for the case of the first embodiment, to improve the economic efficiency, and when the target rotational speed is reduced to $N_B$, the supply flow rate to the actuator is reduced to provide a flow-rate characteristic suitable for precise operation.

Furthermore, in the combined operation in which two or more flow control valves are driven simultaneously, a combination of the above-mentioned control and the operation which does not use this control can suitably be obtained in accordance with the six functional relationships between the target rotational speed $N_o$ and the correction coefficients $K_a$~$K_f$, so that the combined operability can further be improved.

INDUSTRIAL APPLICABILITY

The hydraulic drive system according to the invention is constructed as described above. Thus, the metering range can be made substantially constant regardless of a change in the target rotational speed. Further, precise operation can easily be conducted by reduction of the target rotational speed of the prime mover. Moreover, perceived operability problems can be reduced between the single operation and the combined operation when the target rotational speed is reduced, so that the operability can be improved. Furthermore, since the target rotational speed, not the actual rotational speed of the prime mover, is used to conduct the control, control can be effected in accordance with the output characteristic of the prime mover, and no fluctuation of the control force occurs due to fluctuation of the actual rotational speed. Thus, stable control can be carried out.

What is claimed is:

1. A hydraulic drive system comprising a prime mover, a hydraulic pump driven by said prime mover, a plurality of hydraulic actuators driven by hydraulic fluid supplied from said hydraulic pump, a plurality of flow control valves for controlling flow of the hydraulic fluid supplied to said actuators, and a plurality of pressure compensating valves for controlling respectively differential pressures across the respective flow control valves, said pressure compensating valves being provided respectively with drive means for applying control forces in a valve opening direction for setting target values of the differential pressures across the respective flow control valves, wherein said hydraulic drive system comprises:

first detecting means for detecting a target rotational speed of said prime mover; and control means for controlling said drive means on the basis of said target rotational speed detected by said first detecting means such that said control forces decrease in accordance with a decrease in said target rotational speed.

2. A hydraulic drive system according to claim 1, wherein said control means obtains a correction coefficient of the differential pressure across each of said flow control valves, which decreases in accordance with a decrease in said target rotational speed, said control means calculating a value decreasing in accordance with a decrease in the correction coefficient, as a target value of the differential pressure across the flow control valve, on the basis of said correction coefficient, and controlling said drive means on the basis of said value.

3. A hydraulic drive system according to claim 1, further comprising delivery-rate control means for controlling the delivery rate of said hydraulic pump such that the delivery pressure of said hydraulic pump is higher by a fixed value than the maximum load pressure of said plurality of actuators, wherein the hydraulic drive system further comprises second detecting means for detecting a differential pressure between the delivery pressure of said hydraulic pump and the maximum load pressure of said plurality of actuators, and wherein said control means obtains a correction coefficient of each of said flow control valves, which decreases in accordance with a decrease in said target rotational speed, said control means calculating a value decreasing in accordance with a decrease in said correction coefficient and with a decrease in said differential pressure detected by said second detecting means on the basis of said correction coefficient and said differential pressure, as a target value of the differential pressure across the flow control valve, and controlling said drive means on the basis of said value.

4. A hydraulic drive system according to claim 2, wherein said correction coefficient is 1 when said target rotational speed is at a maximum rotational speed, and decreases at the same rate as the decreasing rate of the target rotational speed.

5. A hydraulic drive system according to claim 2, wherein said correction coefficient is 1 when said target rotational speed is at a maximum rotational speed, and said correction coefficient has a value larger than a ratio of a relatively high first rotational speed, which is less than the maximum rotational speed, with respect to the maximum rotational speed when the target rotational speed is at said first rotational speed.

6. A hydraulic drive system according to claim 2, wherein said correction coefficient is 1 when said target rotational speed is at maximum rotational speed, and said correction coefficient has a value less than a ratio of a relatively small second rotational speed, which is less than the maximum rotational speed, with respect to the maximum rotational speed when the target rotational speed is at said second rotational speed.

7. A hydraulic drive system according to claim 1, wherein said control means includes a controller for calculating a control force value to be applied by said drive means on the basis of at least said target rotational speed, and outputting a control signal corresponding to said control force value, and control-pressure generating means for generating a control pressure in accordance with the control signal and for outputting said control pressure to said drive means.

8. A hydraulic drive system according to claim 7, wherein said control-pressure generating means includes a single solenoid proportional pressure reducing valve operative in response to said control signal.

9. A hydraulic drive system according to claim 7, wherein said control-pressure generating means includes a pilot hydraulic-fluid source, a variable relief valve interposed between said pilot hydraulic-fluid source and a tank and operative in response to said control signal, a restrictor valve interposed between said variable relief valve and said pilot hydraulic-fluid source, and a line between said variable relief valve and said throttle valve communicating with said drive means of the respective pressure compensating valve.

10. A hydraulic drive system according to claim 1, wherein said control means includes a controller for calculating control force values to be applied by said drive means on the basis of at least said target rotational speed individually for each of said pressure compensating valves, and outputting control signals in accordance with said control force values, and control-pressure generating means for generating control pressures in accordance with the respective control signals and for outputting the control pressures respectively to said drive means.

11. A hydraulic drive system according to claim 10, wherein said control-pressure generating means includes a plurality of solenoid proportional pressure reducing valves provided for the respective pressure control valves, and operative respectively in response to said control signals.

12. A hydraulic drive system according to claim 1, wherein each of said drive means of said pressure compensating valves includes a spring for urging in the valve opening direction, and a drive section for applying a control force in a valve closing direction, the control force of the drive means in the valve opening direction being obtained as resultant force of the force of said spring and the control force of said drive section in the valve closing direction, and wherein said control means controls the control force of the drive section in the valve closing direction to control the control force of said drive means in the valve opening direction.

13. A hydraulic drive system according to claim 1, wherein each of said drive means of said pressure compensating valves includes a drive section for applying a control force in said valve opening direction, and wherein said control means directly controls the control force in the valve opening direction.

14. A hydraulic drive system according to claim 1, wherein each of said drive means of said pressure compensating valves includes a spring for urging in the valve opening direction, and a drive section for applying a control force in the valve opening direction which varies a pre-set force of said spring, the control force of said drive means in the valve opening direction being obtained as the pre-set force of said spring, and wherein said control means controls the control force of said drive section in the valve opening direction to control the control force of said drive means in the valve opening direction.

15. A hydraulic drive system according to claim 1, wherein each of said drive means of said pressure compensating valves includes a first drive section for applying a constant control force in the valve opening direction by action of constant pressure, and a second drive section for applying a control force in a valve closing direction, the control force of said drive means in the valve opening direction being obtained as a resultant force of the constant force of said first drive section in the valve opening direction and the control force of said second drive section in the valve closing direction, and wherein said control means controls the control force of said second drive section in the valve closing direction to control the control force of said drive means in the valve opening direction.

16. A hydraulic drive system according to claim 3, wherein said correction coefficient is 1 when said target rotational speed is at a maximum rotational speed, and decreases at the same rate as the decreasing rate of the target rotational speed.

17. A hydraulic drive system according to claim 3, wherein said correction coefficient is 1 when said target rotational speed is at a maximum rotational speed, and said correction coefficient has a value larger than a ratio of a relatively high first rotational speed, which is less than the maximum rotational speed, with respect to the maximum rotational speed when the target rotational speed is at said first rotational speed.

18. A hydraulic drive system according to claim 3, wherein said correction coefficient is 1 when said target rotational speed is at a maximum rotational speed, and said correction coefficient has a value less than a ratio of a relatively small second rotational speed, which is less than the maximum rotational speed, with respect to the maximum rotational speed when the target rotational speed is at said second rotational speed.

* * * * *